US010512940B2

(12) United States Patent
Nishisu

(10) Patent No.: US 10,512,940 B2
(45) Date of Patent: Dec. 24, 2019

(54) DEVICE AND METHOD FOR SORTING OBJECTS

(71) Applicant: NATIONAL INSTITUTE OF ADVANCED INDUSTRIAL SCIENCE AND TECHNOLOGY, Tokyo (JP)

(72) Inventor: Yoshihiro Nishisu, Tsukuba (JP)

(73) Assignee: NATIONAL INSTITUTE OF ADVANCED INDUSTRIAL SCIENCE AND TECHNOLOGY (JP)

( * ) Notice: Subject to any disclaimer, the term of this patent is extended or adjusted under 35 U.S.C. 154(b) by 0 days.

(21) Appl. No.: 15/759,868

(22) PCT Filed: Sep. 20, 2016

(86) PCT No.: PCT/JP2016/077677
§ 371 (c)(1),
(2) Date: Mar. 14, 2018

(87) PCT Pub. No.: WO2017/047812
PCT Pub. Date: Mar. 23, 2017

(65) Prior Publication Data

US 2018/0257108 A1 Sep. 13, 2018

(30) Foreign Application Priority Data

Sep. 17, 2015 (JP) ..... 2015-184070

(51) Int. Cl.
*B07B 4/02* (2006.01)
*B07B 11/02* (2006.01)
(Continued)

(52) U.S. Cl.
CPC ..... *B07B 4/02* (2013.01); *B07B 11/02* (2013.01); *B07B 11/04* (2013.01); *B04C 5/00* (2013.01); *B04C 5/04* (2013.01)

(58) Field of Classification Search
CPC ..... B07B 4/02; B07B 11/02; B07B 11/04; B04C 5/00; B04C 5/04; B04C 5/103; B04C 5/107
See application file for complete search history.

(56) References Cited

U.S. PATENT DOCUMENTS 2,726,763 A * 12/1955 Rakowsky ..... B03B 5/34 209/172.5
5,129,931 A 7/1992 Oranje ..... 55/399

FOREIGN PATENT DOCUMENTS

JP 45-011902 Y 5/1970
JP 52-019884 U1 2/1977
(Continued)

OTHER PUBLICATIONS

International Search Report dated Dec. 27, 2016 in corresponding PCT International Application No. PCT/JP2016/077677.
(Continued)

*Primary Examiner* — Joseph C Rodriguez
*Assistant Examiner* — Kalyanavenkateshware Kumar
(74) *Attorney, Agent, or Firm* — Ostrolenk Faber LLP

(57) ABSTRACT

In order to provide an airflow sorting device having high accuracy and easy adjustment properties with a simple configuration, there are provided a conduit which has a central shaft line and which lets an object to be sorted to fall due to gravity on the inside of the conduit along the central shaft line; an air supply port which is provided at a lower part of the conduit and configured to blow air upward along the central shaft line; a suction port which is provided above the air supply port of the conduit and is an opening oriented downward of a suction pipe provided parallel to the central shaft line; and an input port provided above the suction port of the conduit through which the object to be sorted is input into the periphery of the suction pipe which is in the conduit. Sorting is performed in the sorting device according to
(Continued)

whether or not the object to be sorted is being suctioned by the suction port together with a part or the entirety of an airflow generated in the conduit by the air blown from the air supply port, and an airflow adjusting body which is provided below the suction port in the conduit and blocks a falling path of the object to be sorted which falls due to gravity, is provided, and the airflow adjusting body includes: a vertex on the central shaft line; and an inclined surface having a sectional shape, sectional areas of which are similar to each other and increase in size downward, and a drag force which acts on the object to be sorted which falls due to gravity increases downward from the suction port.

14 Claims, 13 Drawing Sheets

(51) Int. Cl.

| | |
|---|---|
| ***B07B 11/04*** | (2006.01) |
| *B04C 5/04* | (2006.01) |
| *B04C 5/00* | (2006.01) |

(56) References Cited

FOREIGN PATENT DOCUMENTS

| | | | |
|---|---|---|---|
| JP | 53-039766 | A | 4/1978 |
| JP | 53-063085 | U1 | 5/1978 |
| JP | 58-002627 | U1 | 1/1983 |
| JP | 61-216781 | A | 9/1986 |
| JP | 62-065781 | A | 3/1987 |
| JP | 64-063078 | A | 3/1989 |
| JP | 04-131467 | U1 | 12/1992 |
| JP | 06-123421 | A | 5/1994 |
| JP | 07-051626 | A | 2/1995 |
| JP | 07-204584 | A | 8/1995 |
| JP | 08-266938 | A | 10/1996 |
| JP | 10-000620 | A | 1/1998 |
| JP | 2000-202368 | A | 7/2000 |
| JP | 2001-327923 | A | 11/2001 |
| JP | 2003-071386 | A | 3/2003 |
| JP | 2003-237887 | A | 8/2003 |
| JP | 2004-098404 | A | 4/2004 |
| JP | 2005-205282 | A | 8/2005 |
| JP | 2006-218357 | A | 8/2006 |
| JP | 2007-061737 | A | 3/2007 |
| JP | 2014-188452 | A | 10/2014 |
| WO | WO 03/033164 | A1 | 4/2003 |
| WO | WO 2013/145871 | A1 | 10/2013 |

OTHER PUBLICATIONS

Written Opinion dated Dec. 27, 2016 in corresponding PCT International Application No. PCT/JP2016/077677.

Notification of Reasons for Refusal dated Aug. 23, 2016 in related Japanese Patent Application No. 2013-066479, along with an English translation obtained from Global Dossier on Feb. 28, 2018.

Decision of Refusal dated Feb. 7, 2017 in related Japanese Patent Application No. 2013-066479, along with an English translation obtained from Global Dossier on Feb. 28, 2018.

Report of Reconsideration by Examiner before Appeal dated Jun. 30, 2017 in related Japanese Patent Application No. 2013-066479, along with an English translation obtained from Global Dossier on Feb. 28, 2018.

Office Action dated Feb. 6, 2018 in related Japanese Patent Application No. 2013-066479.

Notification of Reasons for Refusal dated Dec. 19, 2017 in related Japanese Patent Application No. 2017-085887, along with an English translation obtained from Global Dossier on Feb. 28, 2018.

* cited by examiner

DEVICE AND METHOD FOR SORTING OBJECTS

CROSS-REFERENCE TO RELATED APPLICATIONS

The present application is a 35 U.S.C. §§ 371 national phase conversion of PCT/JP2016/077677, filed Sep. 20, 2016, which claims priority to Japanese Patent Application No. 2015-184070, filed Sep. 17, 2015, the contents of which are incorporated herein by reference. The PCT International Application was published in the Japanese language.

TECHNICAL FIELD

The present invention relates to a device and a method for sorting objects, and particularly to a device and a method for sorting objects for sorting debris that has been disassembled, crushed, and separated for each material after being discarded and collected, or small-diameter parts, such as elements peeled off from substrates or the like of electronic and electrical equipment in the recycling field, for sorting natural resources in the field of resources, and for performing sorting in order to remove impurities in the field of manufacturing and production.

BACKGROUND ART

Various technologies for sorting and collecting solid particles and the like have been developed in both wet and dry type technologies in accordance with a wide range of objects to be sorted. Among these, a dry type sorting technology which uses not properties that depend on a material type, such as magnetism and electrification properties, but general versatile properties of a solid, such as specific gravity and particle diameter, for example, a technology which applies an inertial force and a wind force has been proposed. Many of these sorting methods are configured to function by combining a centrifugal force or an inertial force, a drag force (gas resistance or the like), transportation effect by an airflow, and a falling motion caused due to gravity, and separate light weight objects and heavy object, has been developed as a technology.

What is required for industrial use as a sorting machine is high versatility. In other words, the ability to simply, easily, and widely adjust the sorting ability to be capable of sorting various types of objects to be sorted which exhibit various physical properties is required. In addition, achieving high sorting accuracy, and being realizable by initial investment and operating costs that correspond to the object is also required. In particular, in the recycling field, such as urban mines where demand has been rapidly increasing in recent years, more cost-effective sorting technology than that of the related art, is required.

In an airflow sorting machine which uses a vertical column as a sorting tank, a dedicated area is narrow and relatively high sorting efficiency can be obtained (for example, refer to Patent Documents 1 to 8). In order to achieve high sorting accuracy with the airflow sorting machine, a certain column length is required, and particularly in a case of a multistage configuration for simultaneous sorting of many types at the same time, a space in the height direction becomes more necessary and becomes a constraint to the installation location (for example, refer to Patent Documents 1 to 7).

Similarly, as a sorting device which uses a vertical column, a sorting device which is provided with a suction port between an input port for inputting an object to be separated into a column and an air supply port for supplying an airflow into the column, and which suctions the object to be separated from the suction port together with the airflow, is known. Since the sorting is performed at a suction port part of the column with respect to the airflow sorting device of the related art which performs the sorting using substantially the entire column, the occupied space in the height direction can be reduced (for example, refer to Patent Document 8). Meanwhile, a difference in gravity falling velocity for each object to be separated can adversely affect the sorting accuracy, and a braking mechanism for mitigating such a difference is required to improve the sorting accuracy (for example, refer to Patent Document 8).

CITATION LIST

Patent Document

[Patent Document 1] Japanese Unexamined Patent Application, First Publication No. H07-204584

[Patent Document 2] Japanese Unexamined Patent Application, First Publication No. 2000-202368

[Patent Document 3] Japanese Unexamined Patent Application, First Publication No. 2003-71386

[Patent Document 4] Japanese Unexamined Patent Application, First Publication No. 2005-205282

[Patent Document 5] Japanese Unexamined Patent Application, First Publication No. 2006-218357

[Patent Document 6] Japanese Unexamined Patent Application, First Publication No. 2007-61737

[Patent Document 7] PCT International Publication No. WO2013/145871

[Patent Document 8] Japanese Unexamined Patent Application, First Publication No. 2014-188452

SUMMARY OF INVENTION

Technical Problem

Incidentally, in incorporating the braking mechanism into the device, it is necessary to consider the influence on the airflow. In addition, the size or shape of the object to be sorted, and the characteristics are various. Furthermore, it is also necessary to satisfy the requirements of existing devices, such as the above-described simplicity, easy adjustment, space saving properties and the like.

In addition, in a column type sorting machine which uses the airflow, the airflow velocity has to be uniform (even) in an orthogonal section in an air supply direction (column direction) of the airflow in common. When high and low distributions occur in the airflow velocity, the rectification countermeasure is necessary since the sorting accuracy deteriorates. However, as the scale of the device becomes larger, it is difficult to take countermeasures in a manner compatible with the requirements of the existing device similar to the braking mechanism.

Here, for example, in Patent Document 8, a mesh-like plate or the like is disposed in the column as the braking mechanism that mitigates the falling velocity of the object by colliding with the falling object. The size and the application position (range) of the braking mechanism are important in order to effectively collide while considering the influence of the occupation of the flow path. In other words, while the probability of collision with a small object to be sorted decreases when a gap expands, and narrowing the gap makes it impossible for a large object to be sorted to pass through.

In addition, in Patent Document 8, it is disclosed that a diaphragm is attached in the column to apply the above-described braking and rectification. However, since the airflow velocity also changes being interlocked to the diaphragm, installation of the diaphragm is not simple. In addition, as the column diameter increases, the space on the inside of the diaphragm becomes greater and the flow velocity distribution width in the column increases even at the same flow rate, and thus, compatibility of braking and rectification becomes complicated.

Furthermore, in Patent Document 7, a mechanism which applies a substantially W-shaped weak swirling flow (W type distribution) is provided over the tube wall-tube center-tube wall in the column, and the wind velocity distribution in the tube section is smoothed and rectified. As described above, as the column diameter increases, similar to a convex flow velocity distribution due to an intrinsic wall friction of the column, the swing width of the unevenness of the W type distribution also increases as well as and the rectification effect becomes limited.

In addition, in Patent Document 4, a multistage wind power sorting device which sorts many types of mixtures at the same time by changing the flow path sectional area of the airflow in stages, collecting light weight objects which float at an average flow velocity of each of airflows that correspond to the sectional area, and sorting the light objects and heavy objects. An obstacle (diffuser) which disperses the airflow is provided in the flow path, and the flow velocity distribution of the airflow is mitigated to obtain a uniform flow velocity. The effect of rectification is restricted and limited to the formation of the intrinsic flow velocity distribution of the tube at a short distance above a linking portion where the tubes having different inner diameters are linked to each other in series (on the downstream side of the flow path).

Furthermore, as a method of rectifying a fluid in the tube, a rectifying plate which gives an inner wall in the column in a direction parallel to the flow path and disperses the influence of wall friction on inside of the column, is generally used, but this is made into a shape of a lattice, and the effect can be increased by increasing the installation quantity. However, due to more occupation of the column, the installation position or quantity are limited. In particular, in the device of the Patent Document 8, since a dedicated mechanism for giving both of the braking and rectification effects is provided in the vicinity of a suction port in the main column where the flow velocity has to be adjusted most precisely, it is extremely difficult to install a rectifying plate at the position in terms of physical (spatial) design.

Furthermore, in the existing device, there is no particular consideration for a case where the device adjustment is necessary while being out of the range of the operation condition, or the extent to make it possible to easily exchange each part and components of the device.

Considering the above-described situation, an object of the present invention is to provide a sorting device having (1) high accuracy with respect to various objects to be sorted, (2) flexible and easy adjustability and controllability to correspond to various objects to be sorted, and (3) flexibility with respect to large and small device scales, and high adaptability, while having a relatively low cost mechanism, structure, and configuration which take a small space and are compact and simple, and a sorting method thereof.

Solution to Problem

An aspect of the present invention is a sorting device configured to sort an object to be sorted. The sorting device includes: a conduit which has a central shaft line and allows an object to be sorted to fall due to gravity inside the conduit along the central shaft line; an air supply port provided at a lower part of the conduit and configured to blow air upward along the central shaft line; a suction port which is provided above the air supply port of the conduit and is an opening oriented downward of a suction pipe provided parallel to the central shaft line; and an input port provided above the suction port of the conduit through which the object to be sorted is input into a periphery of the suction pipe which is in the conduit, in which the sorting device is configured to sort the object to be sorted according to whether or not the object to be sorted is being suctioned by the suction port together with a part or an entirety of an airflow generated in the conduit by the air blown from the air supply port, the sorting device further includes an airflow adjusting body which is provided below the suction port in the conduit and blocks a falling path of the object to be sorted which falls due to gravity, the airflow adjusting body includes: a vertex on the central shaft line; and an inclined surface having a sectional shape, sectional areas of which are similar to each other and increase in size downward, and a drag force which acts on the object to be sorted which falls due to gravity increases downward from the suction port.

According to the aspect of the invention, it is possible to sort various objects to be sorted with high accuracy.

In the above-described aspect of the invention, the airflow adjusting body has a shape of a rotating body. The conduit may have an inner surface inclined portion inclined to expand a horizontal sectional area downward, and the airflow adjusting body may be positioned in the inner surface inclined portion. In addition, the shape of the inclined surface of the inner surface inclined portion of the conduit and the inclined surface of the airflow adjusting body may be controlled to make the flow velocity of the airflow in the inner surface inclined portion constant in a height direction. Furthermore, the conduit may have a ring portion which makes the horizontal sectional area of the inner surface inclined portion oriented downward.

In the above-described aspect of the invention, the airflow adjusting body may position at least a greatest sectional area portion of the airflow adjusting body in the inner surface inclined portion, and the sectional area of the greatest sectional area portion may be greater than the sectional area of an inner surface straight portion. In addition, the airflow adjusting body may be provided with vertical position adjusting means which is configured to move up and down in the inner surface inclined portion and is configured to control the drag force.

Furthermore, in the above-described aspect of the invention, a plurality of suction ports may be provided to be open in the same horizontal plane. In addition, a second suction port which is an opening oriented downward of a second suction pipe provided above the suction port in parallel to the central shaft line, may further be provided. Additionally, each of the flow rates of the suction port and the second suction port may be independently controllable.

Furthermore, according to an aspect of the present invention, there is provided a sorting method for sorting objects to be sorted, in a sorting device which includes: a conduit which has a central shaft line and allows an object to be sorted to fall due to gravity inside the conduit along the central shaft line; an air supply port provided at a lower part of the conduit and configured to blow air upward along the central shaft line; a suction port which is provided above the air supply port of the conduit and is an opening oriented downward of a suction pipe provided parallel to the central shaft line; and an input port which is provided above the suction port of the conduit through which the object to be sorted is input into a periphery of the suction pipe in the conduit, in which the sorting device is configured to sort the object to be sorted according to whether or not the object to be sorted is being suctioned by the suction port together with a part or an entirety of an airflow generated in the conduit by the air blown from the air supply port, the method includes: providing an airflow adjusting body at a lower part of the suction port in the conduit to block a falling path of the object to be sorted which falls due to gravity such that a drag force which acts on the object to be sorted which falls due to gravity increases downward from the suction port.

According to the aspect of the invention, it is possible to sort various objects to be sorted with high accuracy.

In the above-described invention, airflow control may be performed such that the flow velocity of the airflow in a side portion of the airflow adjusting body is constant in a height direction. In addition, the airflow adjusting body may be a rotating body with respect to the central shaft line and has an inclined surface of which a sectional area expands downward.

In addition, the conduit may have an inner surface inclined portion inclined to expand a horizontal sectional area downward, and the airflow adjusting body may be positioned in the inner surface inclined portion.

DESCRIPTION OF EMBODIMENTS

One embodiment of a sorting device of the present invention will be described hereinafter.

Here, "flow velocity" is defined as an average flow velocity unless a specific description is added below. The average flow velocity is a simple calculation value obtained by dividing the flow rate by a flow path sectional area at a predetermined position, and this is defined as the average flow velocity in the flow path section at the position. In addition, regarding the "airflow", airflow generated by a blower or a pump in the atmosphere can be used, but is not limited thereto.

[Sorting Section]

Figure 1:
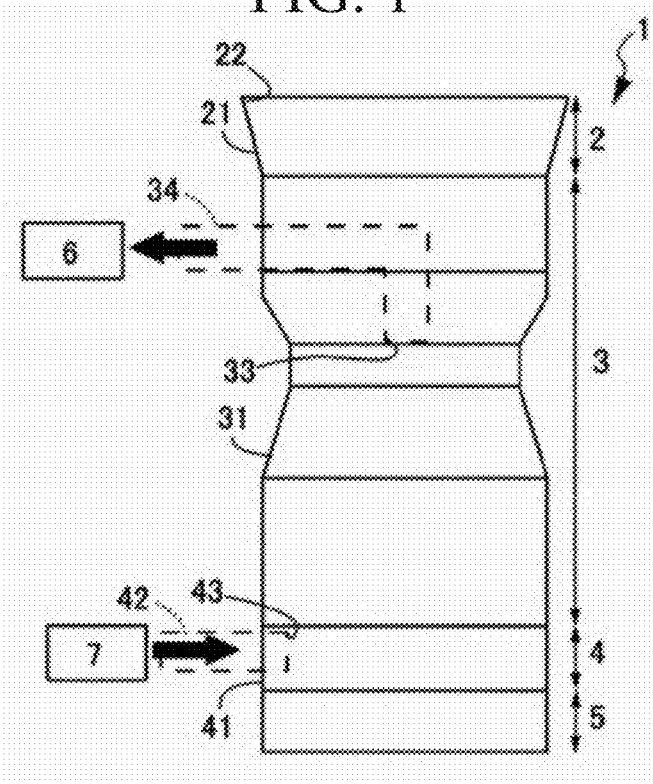
FIG. 1 is a view showing a main portion of a sorting device according to the present invention.

FIG. 1 is a schematic view showing a part (sorting section 1) related to a main sorting operation by basic configuration units. As the configuration unit (unit) of the main elements of the part, there are a unit (introduction unit 2) which is disposed at the top and introduces an object to be sorted (object) into the device; a unit sorting unit (unit sorting unit 3) which performs a unit sorting operation; a unit which introduces the airflow (air supply unit 4); a unit (bottom unit 5) which is disposed below the air supply unit 4, blocks an outflow of the airflow to a lower side than the corresponding position, and is installed at the lowermost part for capturing objects that have passed through all of the sorting units 3, and typically each unit is disposed along the central shaft line.

Figure 2:
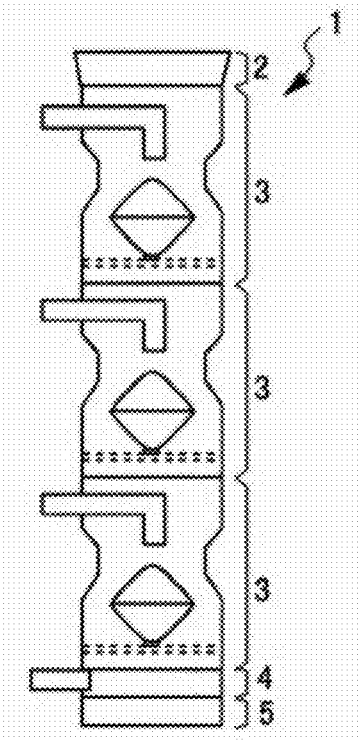
FIG. 2 is a view showing one multistage example of the sorting device according to the present invention.

In addition, as shown in FIG. 2, by configuring a device in which a plurality of unit sorting units 3 are vertically connected to each other, it is possible to make the unit sorting operations multistage and continuous (refer to FIGS. 4 to 7 for the entire configuration). In addition, the configuration unit (unit) is for clarifying necessary functions and elements in the description here, and it is unnecessary to perform drawing (classification) or classification for each physical unit in a real device. Moreover, in terms of operation, it is preferable to have a structure and a configuration which can be physically classified for each unit as necessary from the viewpoint of convenience of adjustment or repair of the device.

Figure 3:
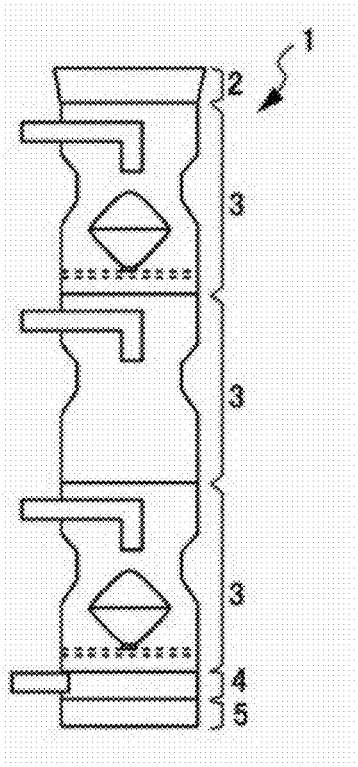
FIG. 3 shows a modification example of FIG. 2.

In addition, the unit sorting unit 3 may be installed in an existing device having a minimum necessary amount of air supply and suction and a mechanism for supplying objects to be sorted in order to perform the same operation as that of the device here. In this case, it is obvious that, at the unit operation part, the configuration is substantially the same as that of the device here, and the sorting function itself operates in the same way. For example, the unit sorting unit 3 can be additionally installed and used for the purpose of partially improving sorting ability and improving efficiency and convenience, in devices or facilities and the like which use Patent Document 2. Even in this case, the same high effect as that of the device can be expected. In addition, contrary to the description above, it is also possible to incorporate an existing sorting unit or the like between some units of the device so as not to affect the unit (for example, refer to FIG. 3, and here, among the three (three stages) unit sorting units 3, a middle unit corresponds to an existing sorting unit).

In addition, a single unit may be configured by using a conduit part (conduit 35 or the like) that serves as a housing in common in units adjacent to each other in the main body of each of the units, and even when three or more original units are used as a single unit, a single unit may be configured by combining all of the units. In addition, in the embodiment, the section of the conduit part (the conduit 35 or the like) is substantially circular unless otherwise specified, but the invention is not limited thereto.

[Introduction Unit]

Figure 5:
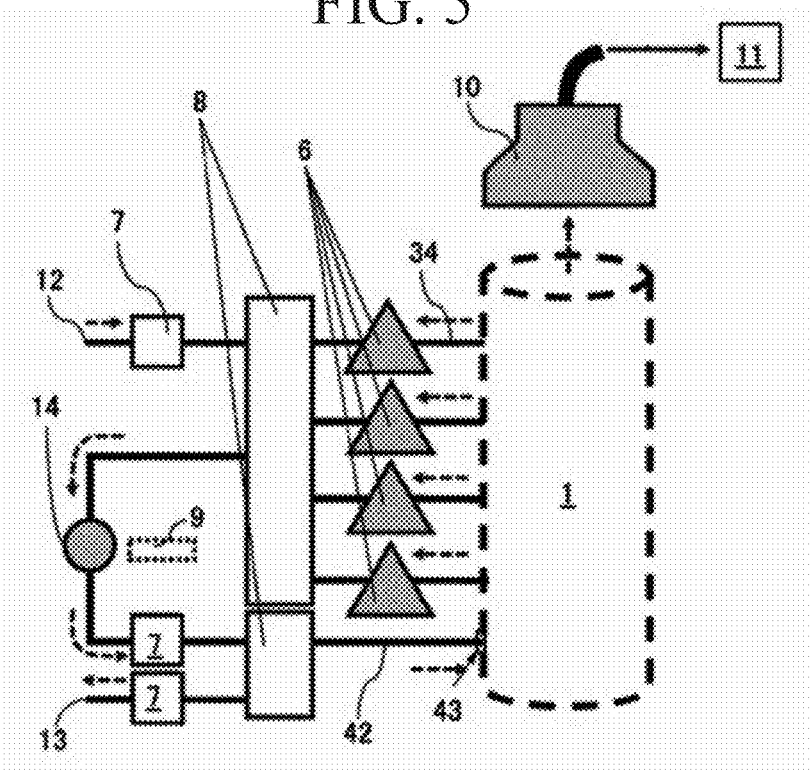
FIG. 5 is a view showing the whole configuration of the sorting method according to the present invention.
Figure 6:
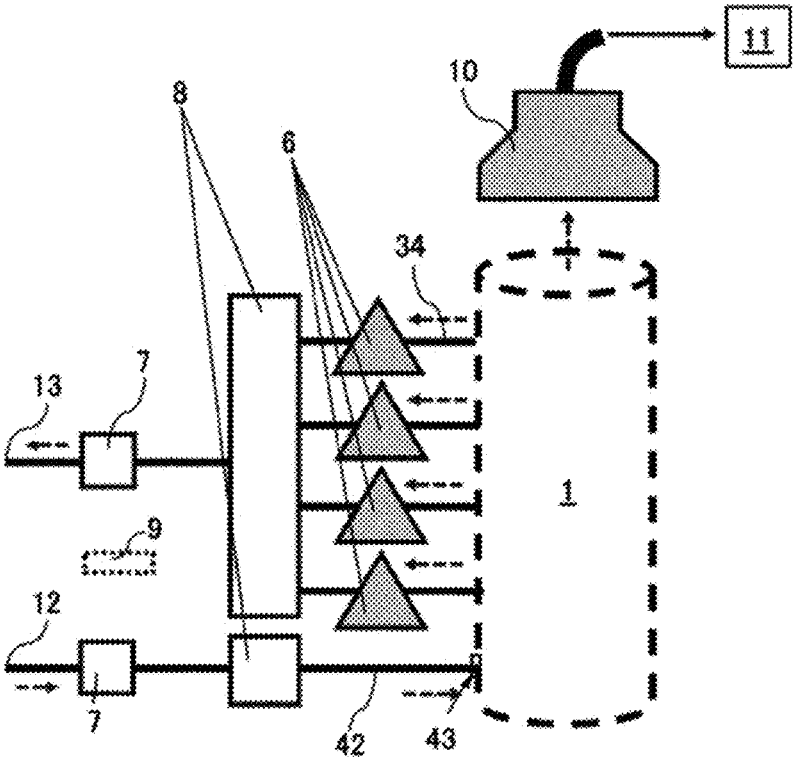
FIG. 6 is a view showing the whole configuration of the sorting method according to the present invention.
Figure 7:
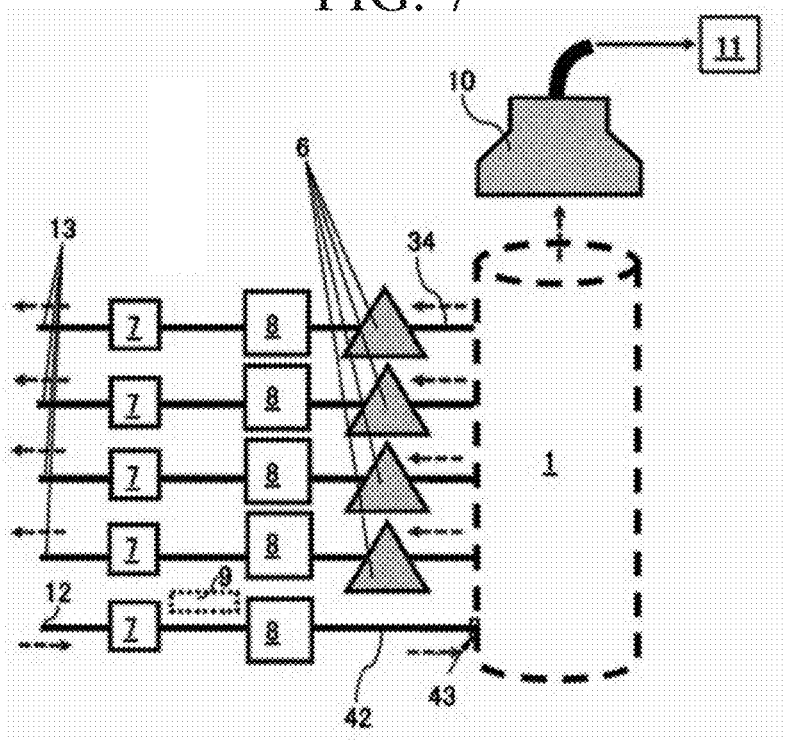
FIG. 7 is a view showing the whole configuration of the sorting method according to the present invention.

The introduction unit 2 is installed for the purpose of supplying the objects to be sorted and collected into the device (sorting section 1). It is possible to provide an input port 22 which is open on the outside of the device, and to introduce the objects to be sorted continuously or intermittently into the device as necessary via an introduction pipe portion (conduit) 21 which forms the input port 22. Supply devices with control devices (vibrating feeders or rotary valves and the like) that can adjust and quantify the input amount may be installed or cooperated from the requirement of device performance, such as sorting accuracy and sorting efficiency. In addition, in a case where it is difficult to input the objects to be sorted due to an outflow of the air from the air supply unit 4 or the like due to fine dust or the like, as illustrated in FIGS. 5 to 7, a dust collecting device 11 for suctioning and collecting dust and the like at a position at which there is no influence on the operation of the device above the input port 22, or an intake hood 10 which is linked to a dust collector installed separately from the device, may be installed. Furthermore, it is possible to install a collection mechanism which separately suctions a lightweight object that is not input to the input port position and collects the objects by a solid-gas separation device, such as a filter. In addition, a transport device, such as a belt conveyor or the like, for continuously supplying the objects to be sorted (such as particulate matters) or an introduction chute or input hopper or the like for assisting the introduction, may be used.

[Air Supply Unit]

The air supply unit 4 is installed for introducing the airflow generated by the blower or the like into the sorting section 1, and can have one or plural air supply ports 43 which are the introduction port of the airflow. Upper and lower units adjacent to each other are connected to each other with high airtightness, a space through which the object or the airflow pass is formed on the inside thereof, and a conduit shape (air supply pipe portion 41) in which single or plural kinds of pipes (conduits) are connected to each other is achieved.

[Unit Sorting Unit]

Figure 8:
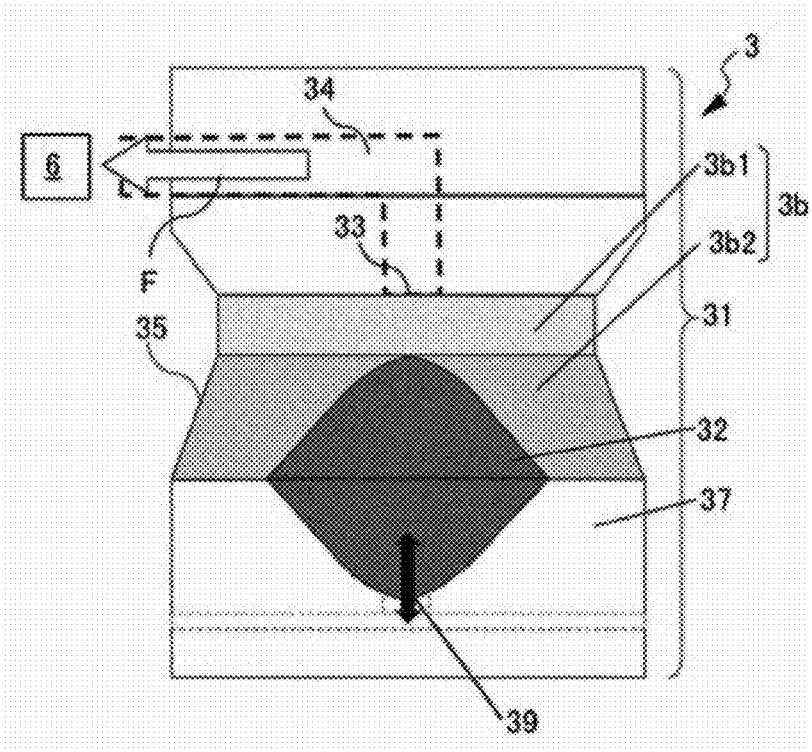
FIG. 8 is a view showing the main portion (unit sorting unit) of the sorting device according to the present invention.

As shown in FIG. 8, the unit sorting unit 3 includes: a conduit-like portion (main pipe portion 31) which has a space through which an object to be sorted and an airflow pass and in which a single or plural types of pipes (conduits 35) connected to each other; a tube inner wall portion wall surface configuring portion (airflow adjusting body 32) which configures a flow path together with the inner wall of the main pipe portion 31 on the inside of the main pipe portion 31; and a supporting portion which fixes the airflow adjusting body 32 to the unit, as basic configuration elements. Furthermore, in the internal space, a conduit portion (suction path 34) which extends from the opening portion (suction port 33) and forms a suction pipe is disposed. A path in which the inside and the outside of the unit are connected to each other and the airflow (arrow F in FIGS. 8 and 11) and the suctioned object are discharged to the outside of the unit via the conduit portion. In addition, it is preferable that the inside of the unit does not have a part that is nearly horizontal or concave or the like such that a falling object can be captured and cannot fall to be lower than this. In addition, it is preferable that molding is performed such that the resistance with respect to the airflow from below becomes small.

Furthermore, the unit 3 is designed as follows. The airflow is introduced into the unit 3, the airflow is suctioned from the suction port 33 in the unit 3 to the suction path 34, and the inside of the main pipe portion 31 on the downstream side of the unit 3 thereafter becomes the airflow amount of the suction residue. It is designed to be capable of adjusting the flow rate distribution within the unit 3, such that the entire supplied airflow amount can be suctioned at the suction port 33 and the residue can be reduced to 0.

In addition, by setting the flow rate distribution of the airflow and the sectional area of the main pipe portion 31 around the suction port 33, considering the vicinity of the suction port 33 as a boundary, a region **3*b*** in which the velocity of the airflow in the column is changed and the flow velocity becomes higher than that in other regions in the unit below the boundary, is formed.

Figure 9:
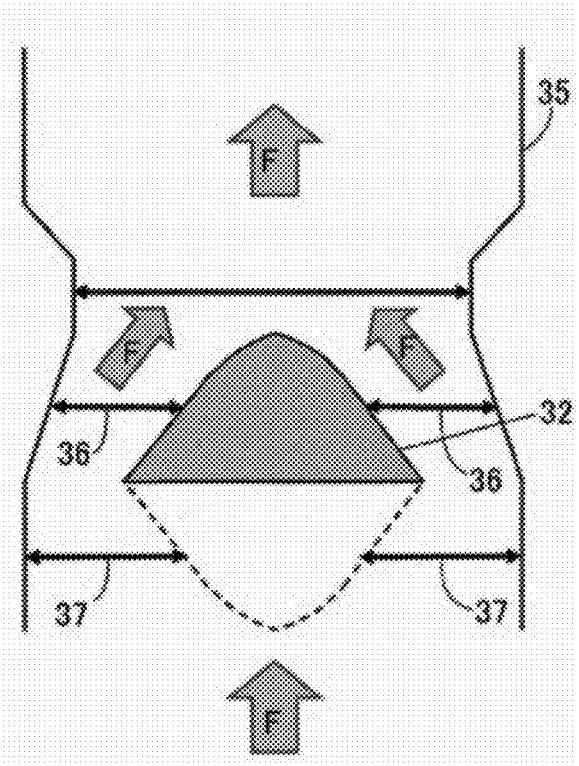
FIG. 9 is a view showing an airflow in a flow path section in FIG. 8.

As shown in FIGS. 8 and 9, the airflow adjusting body 32 is disposed in the region **3*b*, and is formed in a shape of extending (sectional area increases in the upstream direction) downward (the airflow upstream direction on a side opposite to the suction port 33) from a vertex thereof while having the vertex substantially at the central lower position of the suction port 33. In addition, since the airflow adjusting body 32 is intended to adjust the airflow, it is preferable that section outline is a smooth curve and each of the sectional shapes is substantially similar to each other in the height direction except for the vertex to reduce turbulence of the airflow. Furthermore, from the viewpoint of the above-described object, the airflow adjusting body 32 may be a rotating body which considers a straight line that passes through two points including the center position of the suction port 33 and the vertex as an axis to have a more uniform shape. Between the airflow adjusting body 32 and the suction port 33, it is necessary to ensure a space through which the object can pass, and a region 3*b*1 which is a ring portion with a reduced diameter of the conduit 35 including the space is installed above the airflow adjusting body 32. Furthermore, in a lower region 3*b*2 below the region 3*b*1, the inner wall of the conduit 35 of the main pipe portion 31 is molded to have a shape along the facing airflow adjusting body 32. The inner space of the conduit (flow path 36) also becomes an inner surface inclined portion which extends downward from the shape of the region 3*b*2, and the flow path becomes a substantially hollow ring shape (substantially annular shape) due to the existence of the airflow adjusting body 32**.

In addition, in the sorting in the unit 3, whether or not the object to be sorted can pass (fall) due to gravity the region 3*b*, in which the object receives a high drag force due to the velocity of the airflow (the arrow F in FIGS. 9 and 14), is a determination factor of first sorting. Here, the drag force (flow velocity) of the lower region 3*b*2, which is the final passing point of the object to be sorted which falls due to gravity in the region 3*b*, becomes a more dominant configuration and design element.

[Regarding Airflow Adjusting Body and Flow Path on Periphery Thereof]

As illustrated in FIGS. 8 and 9, in the region 3*b*2, the drag force is dominant in determining the sortability in the unit sorting unit 3, and the drag force varies depending on the flow rate in the flow path 36. In order to stabilize the sortability, it is preferable to make the flow path sectional area substantially constant such that the flow velocity change in the flow path 36 does not become significant. For example, in FIG. 8, the sectional area of an airflow channel 36 is designed to have a constant sectional area and to obtain a uniform flow velocity (also refer to FIG. 10 which will be described later).

In addition, the height (length) or the width (aperture) of the airflow adjusting body 32 (airflow channel 36) can be designed with a wide range of sortability and a high degree of freedom. For example, from mechanism point of view, it is preferable that the airflow adjusting body 32 itself serves as a braking mechanism for an object having a high gravitational falling velocity, mainly mitigates the falling velocity by collision with an object that falls due to gravity, and increase the collisionable area (width) of the airflow adjusting body 32 in order to increase the probability of collision with the object that falls due to gravity.

Figure 11:
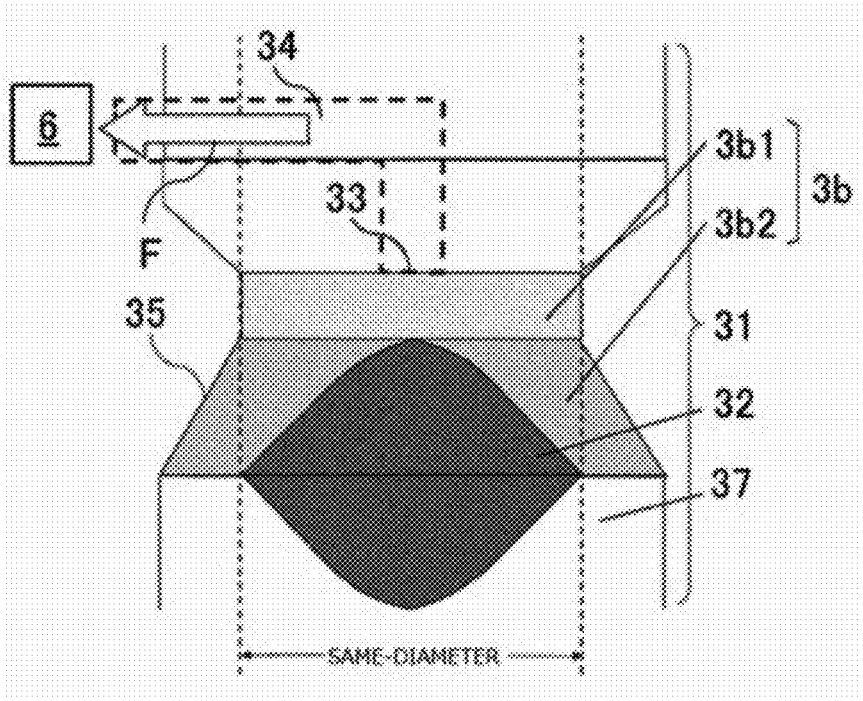
FIG. 11 is a view showing the unit sorting unit which is the main portion of the sorting device according to the present invention.

For example, as shown in FIG. 11, it is preferable that the maximum outer diameter portion of the extending portion of the airflow adjusting body 32 is designed to be equal to or greater than the inner diameter of the conduit 35 of the main pipe portion 31 in the region 3*b*1. In addition, it is preferable that the height (length) of the extending portion of the airflow adjusting body 32 is as low (short) as possible from the viewpoint of space saving. For example, the highest gravitational falling velocity of the object which is estimated to be collected by the suction port 33 in the region 3*b*1 can reduce the gravitational falling velocity in the airflow channel 36, and further, the height of the extending portion may be set in accordance with the distance necessary for changing the movement upward where the suction port 33 is positioned.

Furthermore, as described above, in a case where the flow velocity is set to be substantially constant, a distance dw between the outer wall of the airflow adjusting body 32 that configures the flow path 36 and the inner wall of the conduit 35 decreases as the ratio of the greatest outer diameter of the airflow adjusting body 32 with respect to the inner diameter of the region 3*b*1 increases.

Figure 12:
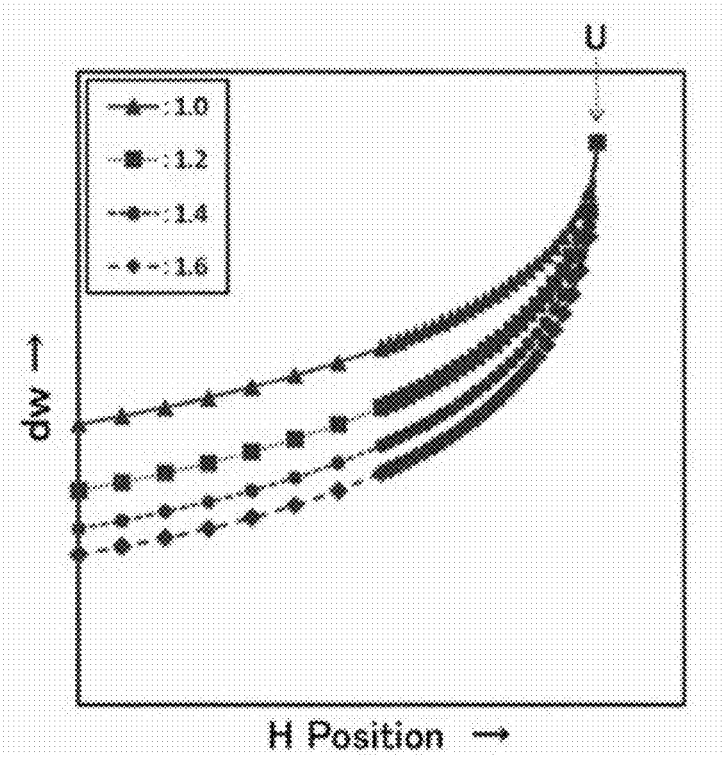
FIG. 12 is a graph showing calculation results of a relative value of the maximum inner diameter of a region **3*b*2 and a distance between an outer wall of an airflow adjusting body 32 and an inner wall and the conduit 35**.

As shown in FIG. 12, in a case where the conduit inner diameter of the region 3*b*1 is constant, when showing a relationship between the relative value (1.0 to 1.6) of the maximum inner diameter of the conduit of the region 3*b*2 and the distance dw, under the premise that the flow velocity is substantially constant, the distance dw is shorter than the inter-wall distance (upper limit value U) in the conduit 35 of the main pipe portion 31 of the region 3*b*1 without the airflow adjusting body 32, and the distance dw further decreases together with the ratio.

Figure 13:
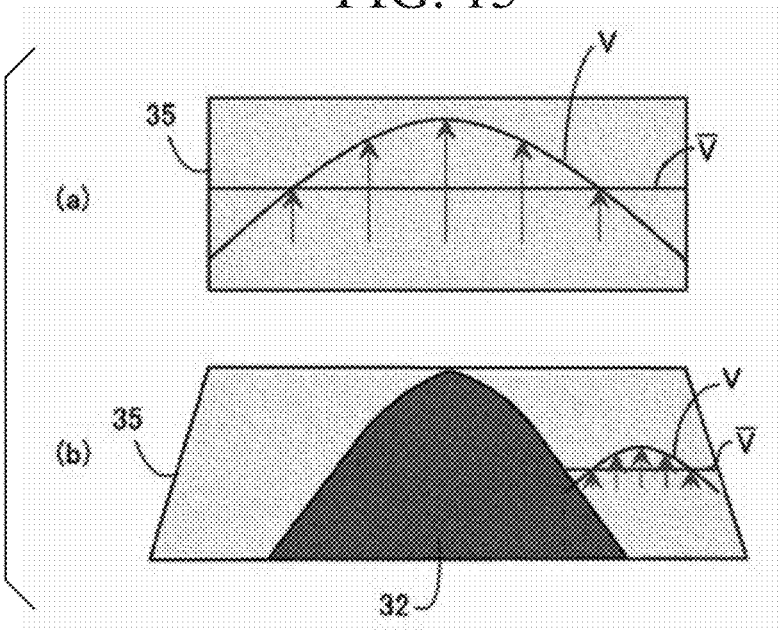
FIG. 13 is a view showing a difference in flow velocity distribution width of a section of a flow path depending on the presence or absence of the airflow adjusting body.

As shown in a portion (a) of FIG. 13 and a portion (b) of FIG. 13, when there is no remarkable difference in physical properties of the flow path wall surface, in a case where the distance is short, the width of the flow velocity distribution (curve V of FIG. 13 (straight line $\bar{v}$: superscript bar indicates the average flow velocity of V)) of the flow path section due to the frictional resistance with the wall surface of the flow path decreases (effect of rectification). In other words, the drag force distribution also becomes constant, and is advantageous from the viewpoint of sortability. Therefore, it is preferable to select the ratio in consideration of the balance between the size of the object to be sorted and the sorting accuracy.

As described above, considering the sorting principle, it is necessary to most strictly adjust the flow velocity, but in the vicinity of the suction port 33 of the unit sorting unit 3, without separately installing a dedicated mechanism that occupies the space in the region, it is possible to obtain both effects of braking and rectification. Furthermore, in a case where the object to be sorted is a mixture of a plurality of types, the collision between the airflow adjusting body 32 and the object can also promote disintegration and separation of the mixture, and thus, an effect of improving the sorting accuracy is obtained.

In addition, the flow velocity (sectional area) of the region 3*b*1 is basically about the same as the flow velocity (sectional area) of the region 3*b*2, but it is preferable to appropriately and finely adjust considering the sorting characteristics (sorting accuracy or velocity). Since the flow path 36 is inclined in the region 3*b*2, a case where the component of the gravity which acts on the object in the direction of the flow path 36 is smaller than the component in the region 3*b*1, may be an investigation item of the flow velocity (sectional area) balance.

[Regarding Form of Airflow Adjusting Body]

As an aspect of the lower part of the airflow adjusting body 32, although details, such as shape and the like, are not specified, a shape with low air resistance is preferable since the lower part faces the airflow. In addition, a support (strut) or the like for fixing the airflow adjusting body 32 in the column may be installed, and in a case of assuming the vertical movement (position adjustment) of the airflow adjusting body 32 which will be described later, a necessary position adjustment mechanism (airflow adjusting body position adjusting mechanism 39) may be installed.

In addition, the characteristics of the airflow in the airflow channel 37 depends on the aspect of the lower part of the main pipe portion 31 and the airflow adjusting body 32, and a case where the flow velocity in the flow path 37 which is immediately below the flow path 36 is higher than the flow velocity in the flow path 36, is not preferable since the possibility that the object which satisfies (drag force on flow path 37>gravity>drag force on flow path 36) is captured at the boundary between the flow path 36 and the flow path 37. In addition, in the configuration in which the flow velocity satisfies (flow path 36=flow path 37), when the necessary and sufficient length of the flow path 36 is installed as described above, the object to be suctioned and collected by the unit sorting unit theoretically does not reach the flow path 37, and there is no particular effect. Meanwhile, in the flow velocity (flow path 36>flow path 37), similar to the combination of the columnar conduit 35 (main pipe portion 31) and a substantially spindle-like structure shown in FIG.

8, when the flow path 37 is configured such that the sectional area decreases as more approaching the flow path 36 side than the upstream side of the airflow, the rectification effect can be expected. In addition, in a case of a multistage structure which will be described later, from the viewpoint of space saving and efficiency, an aspect which is compatible with the lower unit or which is easily connectable and compact, is preferable.

[Installation and Position Adjustment of Airflow Adjusting Body]

Figure 14:
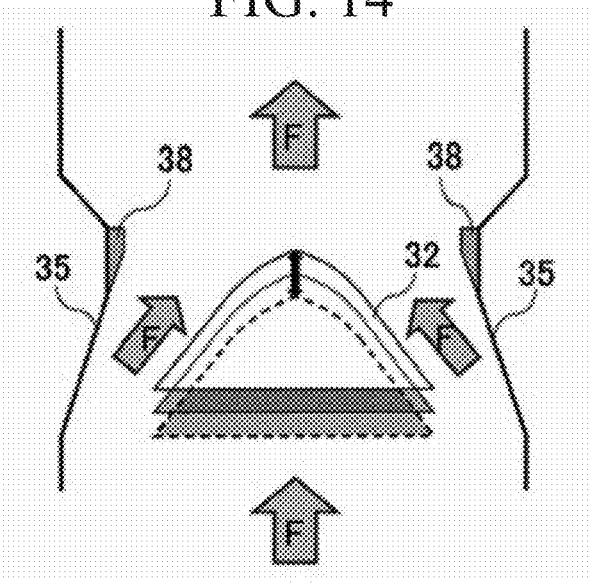
FIG. 14 is a view showing a position of the airflow adjusting body.

In addition, as shown in FIG. 14, in the unit sorting unit, the position adjustment of the airflow adjusting body 32 can be easily performed, and it may be possible to change the sectional area of the flow path 36 between the airflow adjusting body 32 and the conduit 35 according to the position adjustment. By changing the sectional area, the flow velocity, that is, the drag force applied to the object to be sorted can be changed, and the sortability in the unit can be adjusted.

Figure 10:
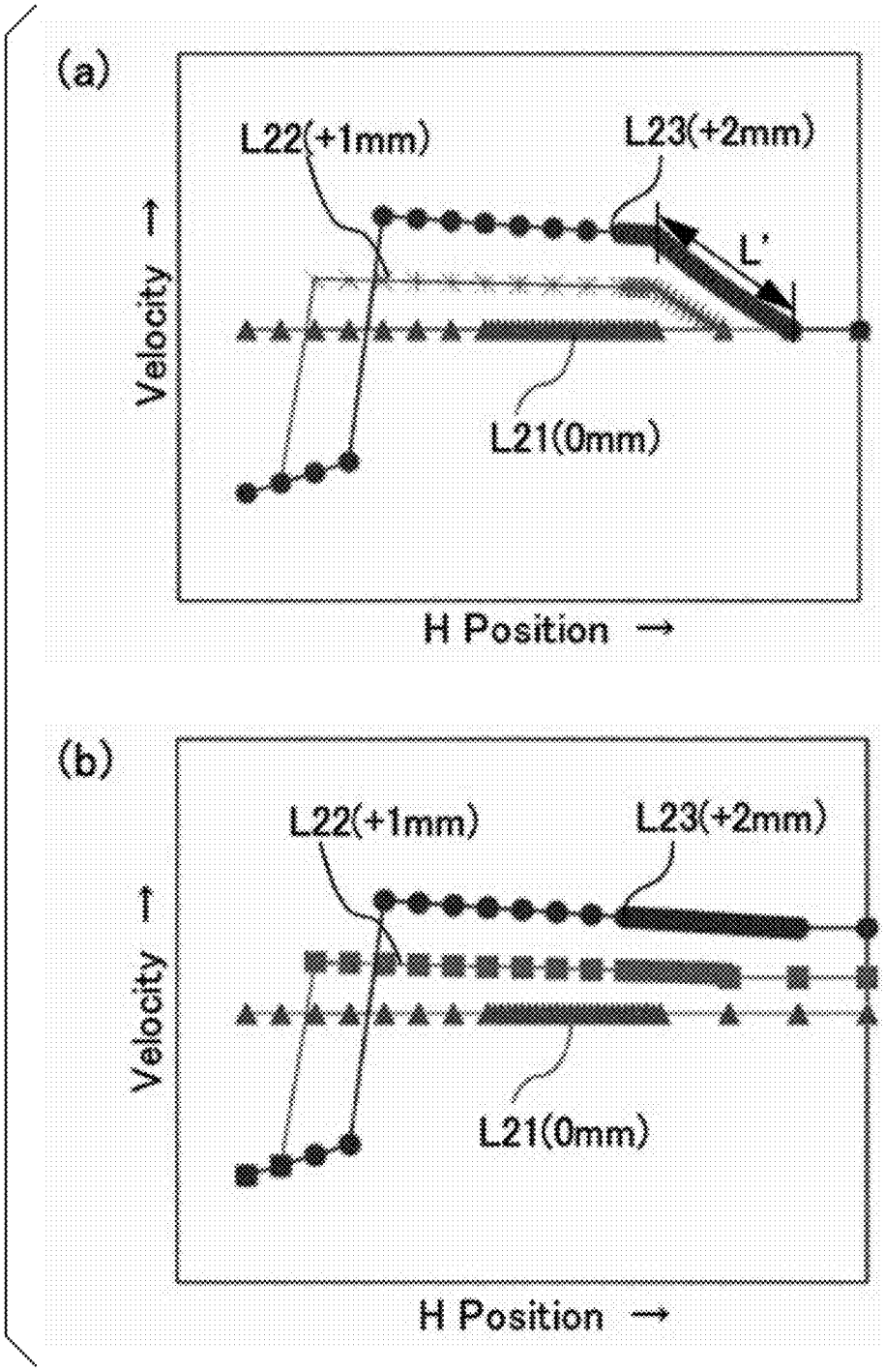
FIG. 10 is a graph showing a calculation result of a relationship between a main pipe portion height and a flow velocity.

In FIG. 10, the flow velocity at the height directional position when the airflow adjusting body 32 is moved in the height direction only by L21 (0 mm, reference position), L22 (+1 mm), and L23 (+2 mm) when the entire region 3*b* has a uniform sectional area, is illustrated. In addition, in a portion (a) of FIG. 10 and in a portion (b) of FIG. 10, graphs when the inner diameter adjusting ring 38 is used as shown in FIG. 14 and when the inner diameter adjusting ring 38 is not used, are respectively shown.

According to this, it can be ascertained that the airflow adjusting body 32 is raised and the flow velocity increases. As shown in the portion (a) of FIG. 10, following the control of the relative position between the airflow adjusting body 32 and the conduit 35, in a case where a section (L' portion in the portion (a) of FIG. 10) in which the flow velocity is relatively low in the region 3*b* is generated, when the inner diameter adjusting ring 38 is installed at the corresponding part, the state can be eliminated as shown in the portion (b) of FIG. 10. In addition, it is preferable that the part of the conduit 35 or the like which has a high possibility of configuration change is designed to be easily exchangeable and adjustable, and here, the adjustment can also be performed by the exchange or adjustment of the part of the conduit 35.

[Adjustment of Suction Amount]

Meanwhile, even when the vertical position of the airflow adjusting body 32 is adjusted, the flow velocity on the upper side (region 3*b*1) than the airflow adjusting body 32 basically does not change. Therefore, corresponding to the flow rate control by adjusting the vertical position of the airflow adjusting body 32, that is, corresponding to the drag force change (increase) which acts on the object to be sorted, the suction amount (flow velocity) of the airflow of the suction port 33 may be adjusted (increased).

[Suction Port and Suction Path]

Figure 15:
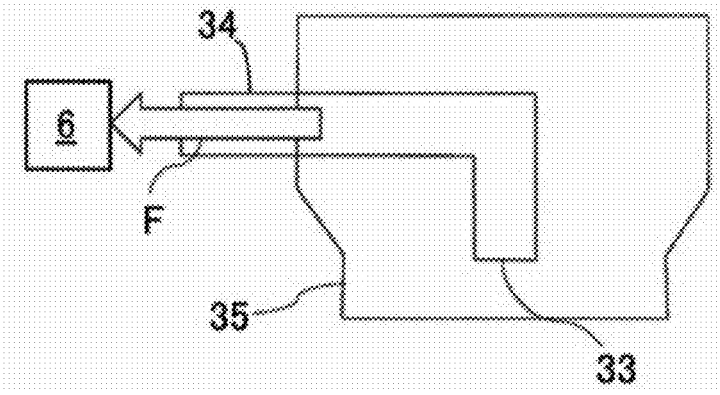
FIG. 15 is a view showing a suction port and a suction path.

As shown in FIG. 15, the suction port 33 which is installed in the unit sorting unit 3, opens an end of the suction path, and forms the suction pipe, is located substantially at the center position in the airflow channel section in the unit 3 and is open substantially in an opposing direction to the airflow. The suction port 33 is connected to the solid-gas separation mechanism 6 installed on the outside of the unit 3 via the suction path 34 that extends in the constant height direction with substantially the same diameter from the suction port 33, is bent, and is introduced to the outside of the unit 3. A downstream side of a path (conduit) which extends from the suction port 33 via the suction path 34, the solid-gas separation mechanism 6 and the like is connected to a blower, a pump, and the like, a part of the airflow in the unit 3 is suctioned by the suction port 33, and the flow rate and the flow velocity in the unit 3 is adjusted. In addition, among the objects to be sorted introduced from the introduction unit 2, objects that cannot pass (fall) through the unit are suctioned and collected together with the airflow (arrow F in FIG. 15). In other words, whether or not the object to be sorted is suctioned by the suction port 33 is the determination factor of the second sorting.

Figure 16:
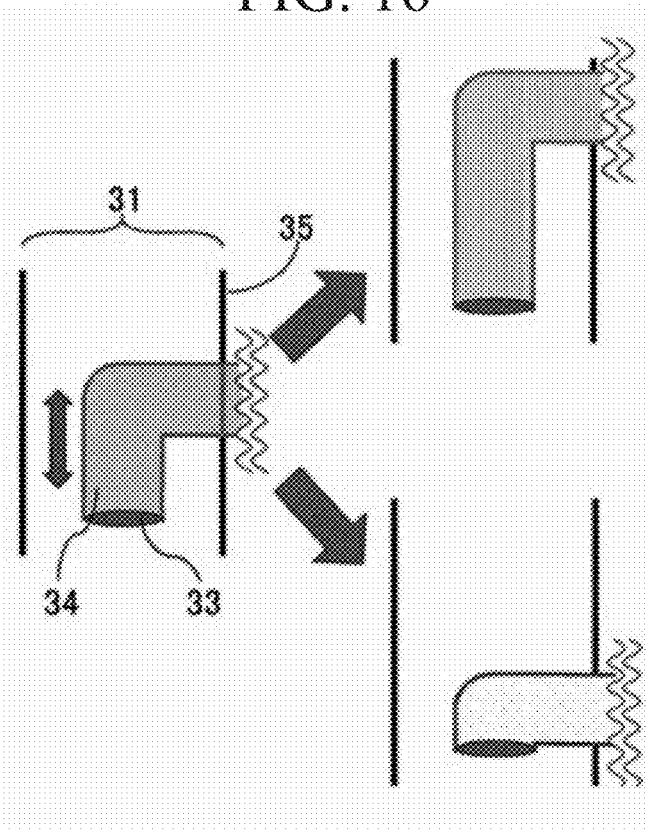
FIG. 16 shows a modification example of FIG. 15.
Figure 17:
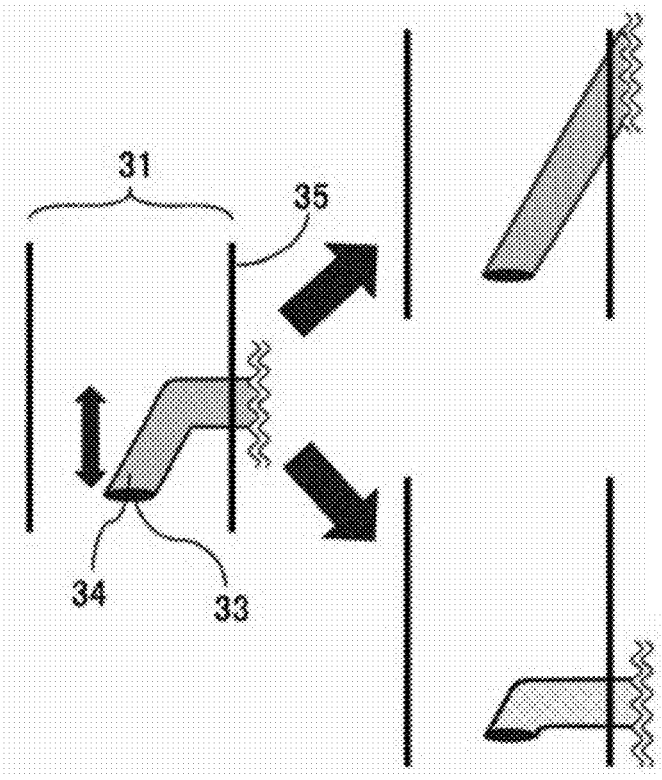
FIG. 17 shows a modification example of FIG. 15.

Here, as shown in FIG. 16 or 17, by changing the properties of the suction path 34 immediately above the suction port 33 which forms the rising airflow that opposes the gravity fall, in particular, the path length or the like of the suction path 34 in the height direction may be adjustable. In addition, from the viewpoint of the accuracy of suction (airflow stability), it is preferable to design the shape, such as the orientation or the sectional area of the conduit, such that the flow velocity (suction force) in the suction path 34 becomes constant. In particular, with respect to the suction pipe portion formed by opening the end of the suction path, bias and disturbance are likely to occur in the distribution of the flow velocity in the unit 3, which is immediately below the suction pipe portion, depending on the orientation of the airflow to be suctioned. Therefore, in order not to cause this, it is desirable that the suction pipe portion extends upward in a direction parallel to the central shaft line which is equal to the orientation of the airflow in the unit 3. Moreover, as shown in FIG. 16, the length of the suction pipe portion is made as short as possible depending on the circumstances or the like of the device configuration, and the height or the length of the inclined part of the suction path 34 positioned at the upper part thereof may be adjusted.

[Regarding Number of Suction Ports in Unit Sorting Unit]

Figure 18:
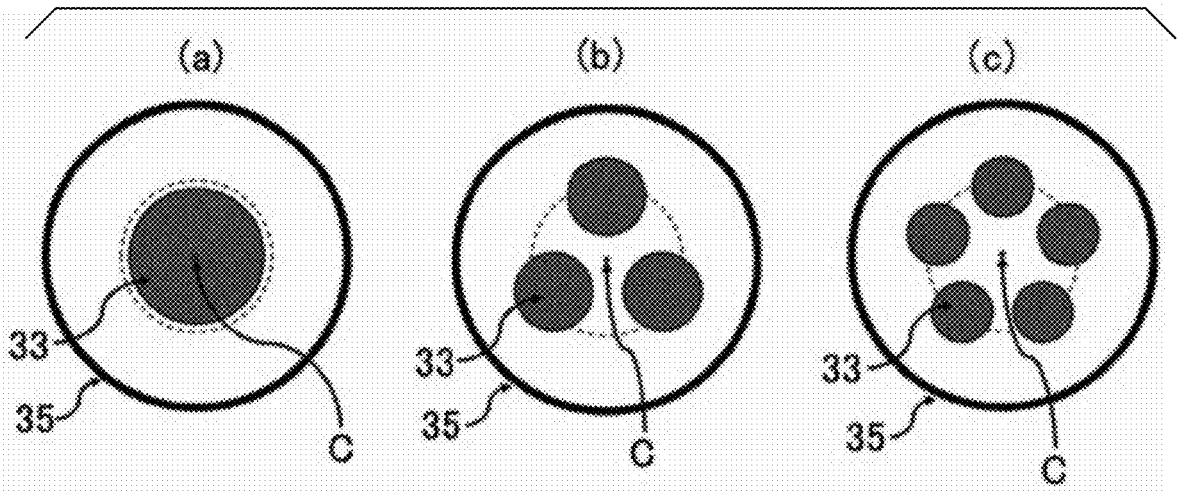
FIG. 18 is a view showing disposition of a plurality of suction ports.

As shown in FIG. 18, a plurality of suction ports 33 in the unit sorting unit 3 may be provided. In a case of the plurality of suction ports 33, the physical properties and characteristics of the object to be sorted taken in from each of the suction ports 33 substantially match each other, and the suction port 33 having a relatively strong suction force is also installed to be adjustable so as not to suction the object to be sorted having the physical properties which passes through the region 3*b* having the highest flow velocity in the unit positioned below the suction port 33. In order to satisfy this condition, for example, the shape and structure of the entire suction port 33 are made the same, and furthermore, disposition of the same condition may be set in the unit 3. In a case where sections of columns or the like of each of the configuration elements of the unit 3 are all concentric circles, the configuration elements may be disposed at equal distances from the center point (C in FIG. 18) at even intervals.

In a case where the output of a power source, such as a blower or a pump responsible for suction is restricted (small), or in a case of reducing influence of an aperture on the flow velocity distribution of the section of the suction port 33 when making a large-scale device, installation of the plurality of suction ports 33 can be considered.

[Mechanism of Air Supply and Intake]

Figure 4:
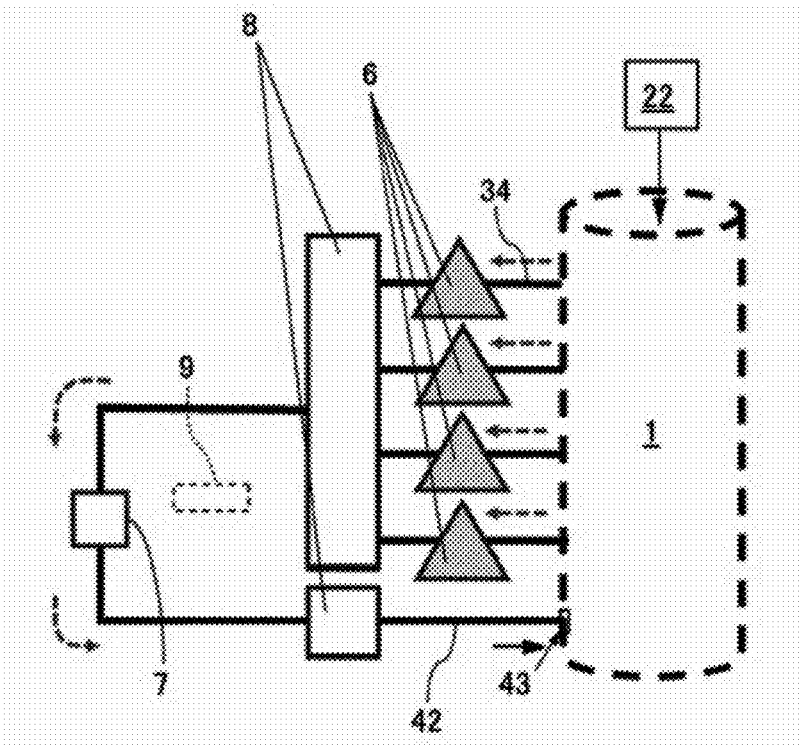
FIG. 4 is a view showing the whole configuration of a sorting method according to the present invention.

In FIGS. 4 to 7, the air supply mechanism and the suction mechanism are illustrated. FIG. 4 shows an embodiment in which one blower is used for air supply and intake, and air which is supplied and which is taken are circulated, FIGS. 5 and 6 show embodiments in which the blowers for air supply and intake are independently installed, respectively, and FIG. 7 shows an embodiment in which the blowers for intake are further installed independently for each of the unit sorting units 3. In addition to this, when there is a pump or the existing intake and exhaust equipment at the installation location of the equipment instead of the blower, the pump or the existing intake and exhaust equipment may be used, and it is also possible to increase the number of air supply and intake systems installed in the device considering the scale of the device or the output or the like of the available air supply and intake device.

[Management of Airflow]

Here, since the airflow is used as a driving force for sorting, it is necessary to manage and control the flow rate or the like of airflow, a mechanism for output management or control may be provided in the air supply and intake mechanism that serves as the airflow generation source, and valves for adjusting the flow rate in the air supply and intake path, or measuring instruments or the like for measuring the flow rate, the flow velocity, or the like may be installed.

FIGS. 4 to 7 show an example in which a management and control mechanism (flow rate and flow velocity control section 8 and control device 9), and a blower 7 which is capable of adjusting and monitoring the output by the management and control mechanism, are used.

Figure 19:
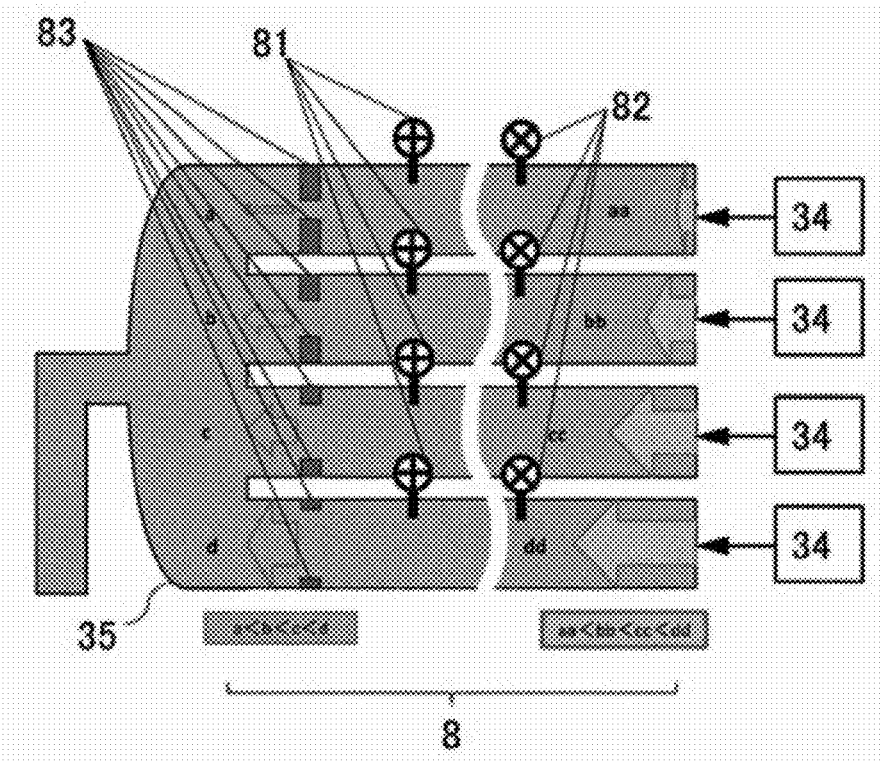
FIG. 19 is a view showing a mechanism of output management and control of supplied and intake air.

As shown in FIG. 19, while performing measurement of the sorting section 1 in the management and control mechanism (flow rate and flow velocity control section 8 and control device 9) in the examples of FIGS. 4 to 7, a flow rate and flow velocity meter 81 for a control signal and a flow rate adjusting valve 83 and the like which has an external signal input and output for adjusting an opening degree are provided, and in addition to monitoring the total flow rate of the airflow, monitoring and adjusting the flow rate of the airflow to be suctioned in each of the suction ports 33 may be performed. Meanwhile, the total amount of airflow at the same time may also be measured by using an output variable blower having external signal input and output for output adjustment. In addition, the present invention is not limited to the above-described example as long as air supply and intake necessary for the operation of the device is performed, and may be individually and manually adjustable.

[Solid-Gas Separation Mechanism and Collection Tank]

An object P suctioned together with the airflow (arrow F in FIG. 20) from the suction port of the unit sorting unit 3 is collected by being separated from the airflow. Although the part at which the separation operation is performed is defined as the solid-gas separation mechanism 6, a structure which simply increases the diameter of the flow path or the like and reduces the flow velocity from the gravity falling of the object P to the separation from the airflow may be employed.

Figure 20:
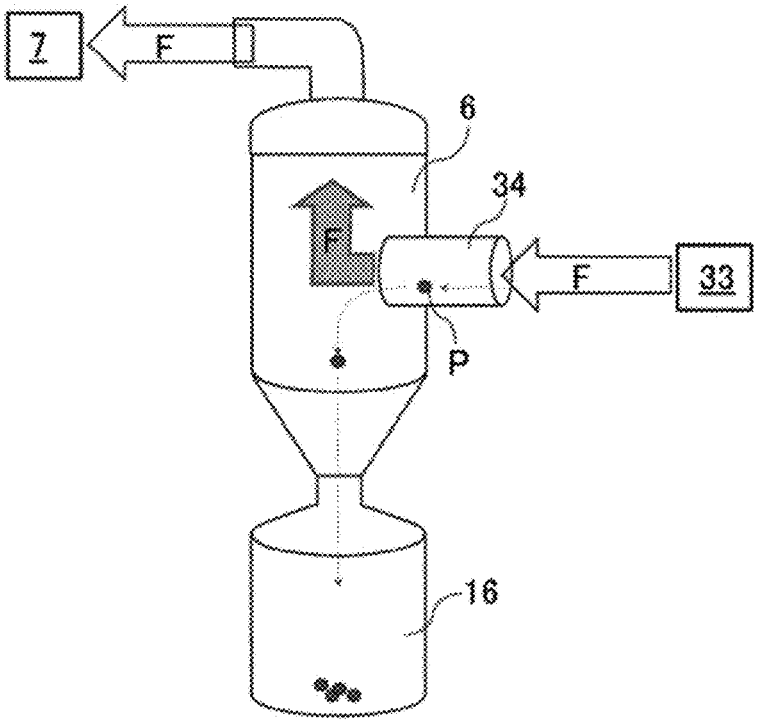
FIG. 20 is a view showing a solid-gas separation mechanism and a collection tank.

In addition, as shown in FIG. 20, a dedicated device, such as a cyclone, may be installed, and even when the collection tank 16 for ensuring the object after the solid-gas separation may be installed under the solid-gas separation device. Furthermore, even when the collection tank is provided with a discharge mechanism for discharging the object out of the device while the device is operating (at any timing, sporadically, intermittently, or continuously), the collection tank itself may be replaced with the discharge mechanism.

Figure 21:
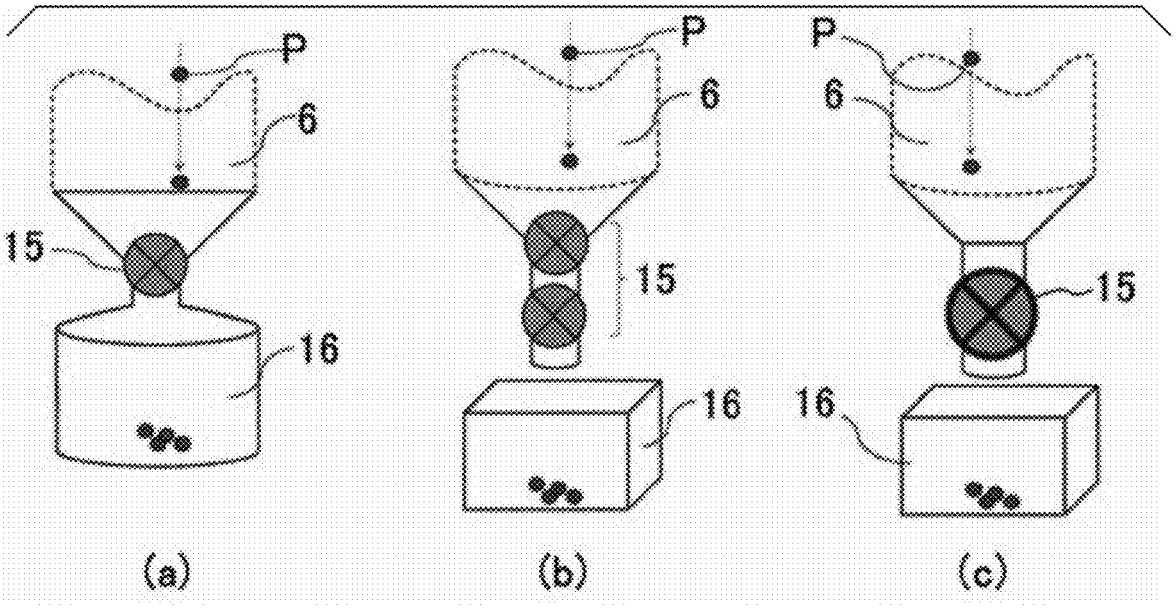
FIG. 21 is a view showing another solid-gas separation mechanism and a collection tank.

A portion (a) of FIG. 21 shows an embodiment in which a valve (individual collecting valve 15) is installed between the solid-gas separation mechanism 6 and the collection tank 16 such that the collection tank 16 can be removed. In addition, a portion (b) of FIG. 21 shows an embodiment in which valves are installed in a multiplexed manner such that airtightness of an outlet is ensured so as not to leak the airflow even during operation of the device, and such that the object can be easily taken out of the device. In addition, a portion (c) of FIG. 21 shows an embodiment in which a rotary valve which is capable of ensuring airtightness is installed. In addition, these collection mechanisms may be installed in the bottom unit 5.

[Supplemental Management of Airflow during Recycling]

As shown in FIG. 4, in a case where the airflow is recycled by one single blower 7, the airflow does not flow in and out of the device, that is, there is basically no intake and exhaust at the input port 22 that serves as an opening. Therefore, it is unnecessary to consider that lightweight objects to be sorted are prevented from being input by the exhaust of the input port 22. However, the unit sorting unit 3 which is immediately under the introduction unit 2 can be restricted by the relatively small amount of airflow.

Here, as shown in FIG. 5, by providing the intake port 12 of the external air, it is possible to obtain an increase in the flow rate due to the air supply, and it is possible to mitigate the limitation on the above-described relatively small amount of the airflow. In addition, there is also an effect of mitigating the heating of the circulating airflow due to the amount of heat of the blower. Furthermore, by providing the exhaust port 13, it is possible to generate a negative pressure at the input port 22 to suction the air, to assist introduction of the object to be sorted, and to mitigate the heating of the airflow. In addition, the dedicated blower or the like for assisting the exhaust or the intake may be provided. As a countermeasure against heating, a gas cooling mechanism 14 for cooling the airflow may be introduced.

In addition, as shown in FIGS. 6 and 7, unless the airflow is recycled, it is necessary to install the intake port 12 and the exhaust port 13. At this time, temperature control of the external air to be suctioned can be used for temperature adjustment of the airflow.

[Temperature Management]

As shown in FIG. 19, since the temperature of the airflow at the time of operation of the device fluctuates not only at the time of recycling of the supplied and suctioned airflow, but also by the room temperature, considering the influence on the device due to the temperature change of the airflow, the measurement instrument for the airflow temperature (thermometer 82) and management and control of the airflow incorporating measured values may be introduced.

[Other Measures or the Like]

In addition, the device may include: a diselectrifying mechanism for preventing the influence of static electricity, such as electrostatic adhesion or the like of an object to be sorted; or a dehumidifying and drying mechanism from the viewpoint of maintenance of the device or the like for preventing adhesion due to moisture crosslinking of the object.

[Regarding Conduit for Main Pipe Portion or Suction Path]

Figure 22:
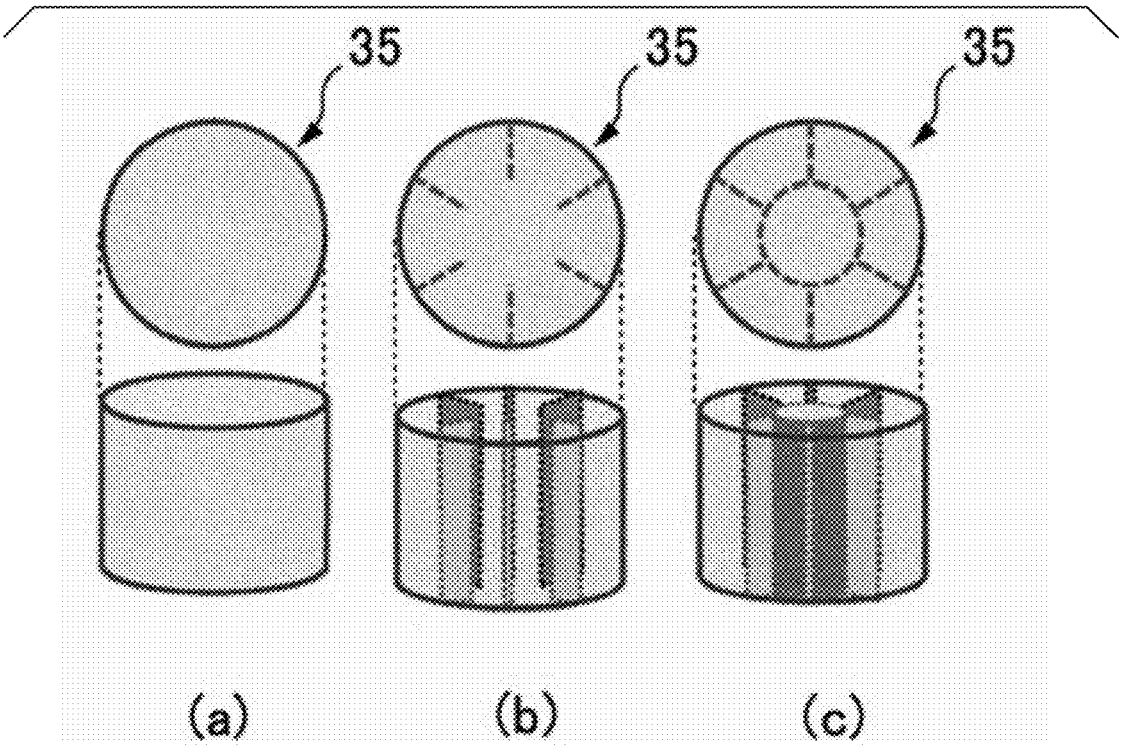
FIG. 22 is a view showing a conduit including a rectifying mechanism.

In the conduit, such as the main pipe portion 31 and the suction path 34, a diaphragm (for example, refer to Patent Document 8) for partially reducing the inner diameter to increase the flow velocity for the purpose of rectification assistance, a rectifying mechanism may be provided as shown in FIG. 22. In addition, in the conduit of the main pipe portion 31, a braking mechanism for assisting braking of gravity falling of the object to be sorted may be provided (for example, refer to Patent Document 8). In addition, for the purpose of optimizing various properties, such as the size and specific gravity or the like of the object to be sorted and various conditions, such as throughput, a part or the entirety of the conduits which configures the main pipe portion 31 can be exchanged, or as an easily adjustable mechanism or structure, the inner diameter or the sectional area may be freely changed. In addition, it is preferable that the inner wall surface of the conduit which has a possibility of being in contact with the object to be sorted, is smooth so as not to capture the object to be sorted.

[Overall Configuration]

In various configuration elements, it is possible to equip a plurality of identical configuration elements, and not being limited to the above-mentioned embodiment, and any combinations or the number of configurations can be selected. Furthermore, various aspects, such as the size, can be set for individual configuration elements.

Figure 23:
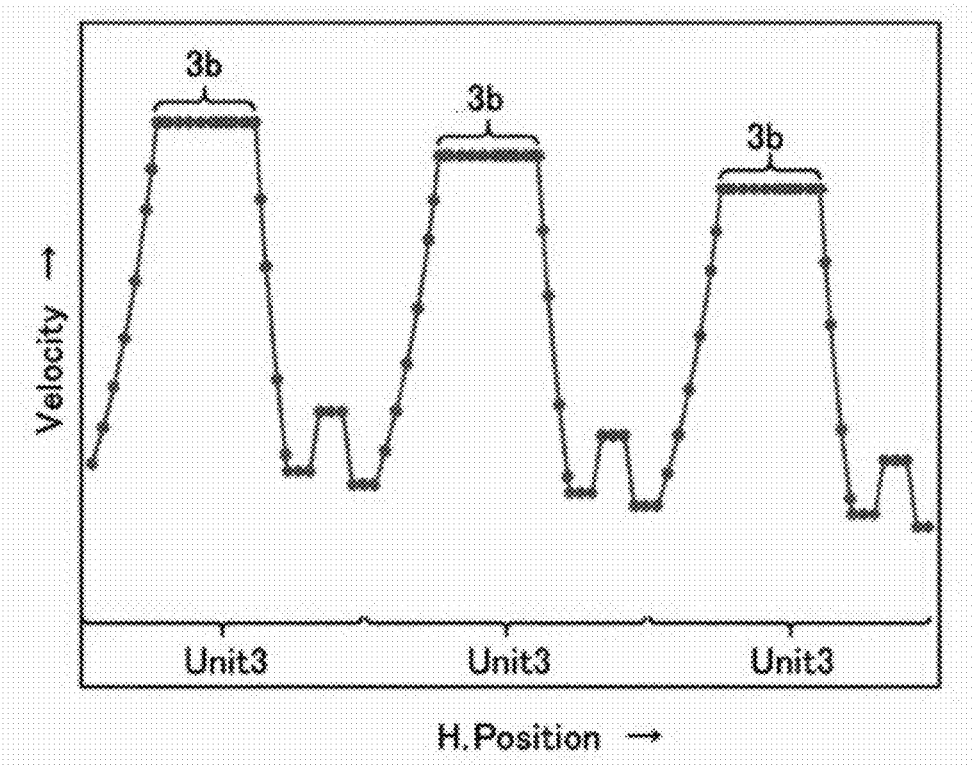
FIG. 23 is a graph showing calculation results of changes in flow velocity in a case where a plurality of unit sorting units are linked to each other.

For example, in FIG. 2 (schematic view of sorted multistage formation) and FIG. 23 (flow velocity change graph at the time of multistage formation), a multistage embodiment including three unit sorting units 3 having the same shape is shown. The number of stages is not limited to three stages, and can be selected (increased or decreased) as necessary. In addition, the size or the shape of each of the unit sorting units 3 may also be appropriately and separately designed according to the aspect, physical properties, absolute amount of the object to be collected in each unit and the ratio (distribution) with other objects. In addition, when installing the plurality of unit sorting units 3, the air supply unit 4 may be additionally installed between the units as necessary for the purpose of increasing the airflow of the upper unit sorting unit 3.

In the management and control of the airflow as the above-mentioned device, it has to be designed such that unintended significant airflow does not go in and out between each of the configuration units or between the units other than the opening portion installed as an airflow entry and exit portion. Accordingly, even in the sorting section 1 which uses the airflow as the driving force of operation, the airflow conditions, such as the flow rate or the like, can be managed and controlled being interlocked to the management and control of the supplied and intake air. As will be described later, the flow velocity is important as a factor for determining sortability in the sorting section 1, but the flow velocity may be directly measured by installing the measurement instrument in the sorting section 1, or calculations values at any position obtained by the measurement of the flow rate and the design sectional area or other various measurement values that can indirectly estimate the flow velocity, and the measurement instrument may be used, and further, the measurement instrument of the sorting section 1 may be omitted when the flow velocity of the sorting section 1 can be calculated and estimated from the airflow management of the entire device.

[Sorting Operation]

The object to be sorted is introduced into the device (sorting section 1) from the input port 22 of the introduction unit 2, and the introduced object is supplied to the unit sorting unit 3 of the sorting section 1 due to gravity falling. In addition, in a case where there are a plurality of unit sorting units 3, the object which was supplied to the uppermost unit at the beginning and passed through the uppermost unit due to gravity falling is supplied to the unit of the next stage, and is also similarly supplied to the unit of the lower stage. Whether the object to be sorted can pass through each of the unit sorting units 3 reflects the sorting result of the sorting unit. In a case where there is no passing object as a sorting result, the object is not supplied below the unit.

In each of the unit sorting units 3, the supplied object is sorted as an object which can pass through or which cannot pass through the region 3*b* having a relatively high airflow velocity in the unit. The object which has passed through the region 3*b* falls due to gravity without remaining in the unit and is supplied to the lower unit. Meanwhile, the object which has become impossible to pass through the region 3*b* is suctioned together with the airflow from the suction port 33 installed in the unit, and is carried out of the unit (sorting section 1) via the suction path 34. Therefore, in advance, each suction force is adjusted to a suctioning force which is capable of suctioning an object that cannot pass through the region 3*b* of the unit. At the time of the adjustment, a flow velocity which is equal to or higher than that of the region 3*b* is required, but on the other hand, when the flow velocity is remarkably higher than that of the region 3*b*, even the object that can pass through the region 3*b* is suctioned. In addition, the suctioned object is separated from the airflow by the solid-gas separation mechanism 6 via the suction path 34 and can be collected by the collection tank or the like, but it is necessary to design the object not to remain in the middle of the path due to deterioration or the like of the flow velocity in the middle of the path.

When the plurality of unit sorting units 3 are installed and the sorting process is multi-staged, sorting by units can be carried out continuously. In addition, in the lower unit, unless the flow velocity in the region 3*b*, that is, the drag force caused by the flow velocity is greater than that in the upper unit, it is impossible to collect the object that has passed through the upper unit. Therefore, the design or operation condition is basically set to increase the flow velocity in the region 3*b* as approaching the lower stage. Furthermore, objects that have passed through all of the unit sorting units 3 can be collected by the bottom unit 5 provided below the unit of sorting section 1 or via a bottom unit, separately using the collection tank or the like. In the device, it is possible to have the capability of basically sorting the unit sorting unit 3 by the number obtained by adding 1 to the number of installations of the unit sorting units 3 for the single supply.

According to the above-described sorting device, it is possible to realize a sorting device having (1) high accuracy with respect to various samples, (2) flexible and easy adjustability and controllability to correspond to various samples, and (3) flexibility with respect to large and small scales, and high adaptability, while having a relatively low cost mechanism, structure, and configuration which takes a small space and are compact and simple only by employing the configuration in which the airflow adjusting body is disposed, and a sorting method thereof.

[Description of Principle of Present Invention]

Figure 24:
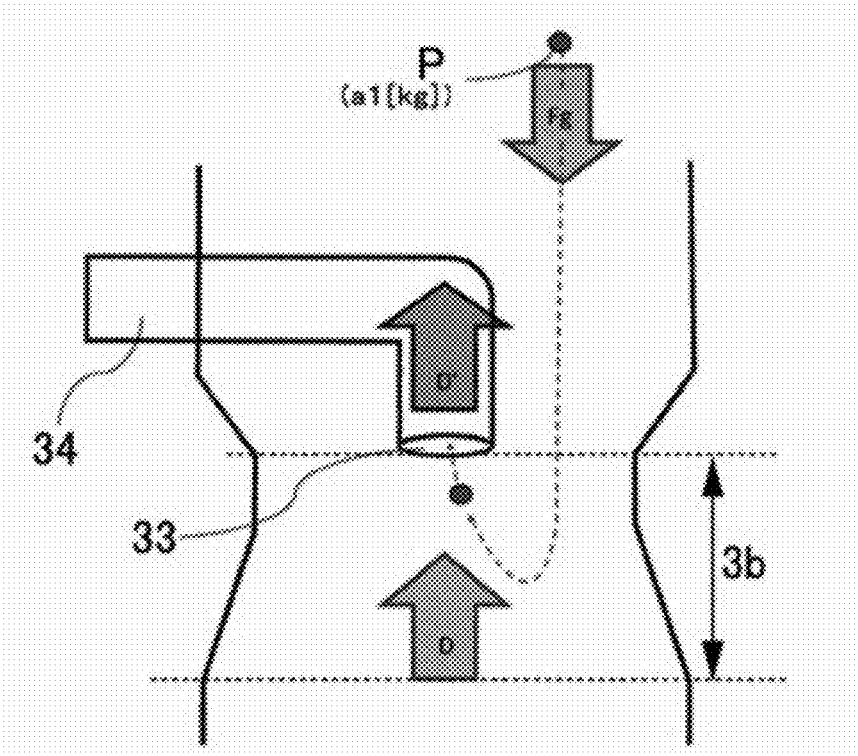
FIG. 24 is a view showing a sorting principle of an object to be sorted.

FIG. 24 is a view showing a sorting principle by the unit sorting unit 3 in the sorting device according to the present invention.

When referring to FIG. 1, when the mass of the object P supplied to the sorting unit 3 from the introduction unit 2 is a1 [kg], the gravity which acts on the object P (represented by Fg) generally satisfies $Fg=9.8\times a1[N]$.

Meanwhile, a drag force (D) which acts on the object in the region 3*b* of the unit sorting unit 3, due to the airflow introduced to the sorting section 1 from the air supply unit, satisfies $D=\rho\times V^2\div 2\times s\times C_D$ when p is density of the fluid, V is the relative velocity with respect to the object P, s is the representative area of the object, and $C_D$ is the drag force coefficient. Here, assuming that p is the air density, and the drag force coefficient $C_D$ and the gravitational falling velocity of the object P are constant, the variable V is a sum of the velocity (flow velocity) of the airflow and the gravitational falling velocity (constant) of the object P, and thus, D is adjusted and determined by the flow velocity of airflow 36.

In addition, as a force which acts on the object P other than the drag force, there is buoyancy. But, for example, in a case where the airflow is a flow of air and the specific gravity of the object P is approximately 1, the buoyancy is substantially small with respect to gravity, and thus, the buoyancy can be substantially ignored.

In other words, when the object P has a specific gravity of 1 (density: 1 [g/cm$^3$], 1000 [kg/m$^3$]) and under the atmospheric pressure in temperature of 20° C. (atmospheric density: 1.205 [kg/m$^3$]), the (buoyancy/gravity) ratio is substantially small as 1.205/1000. Here, in the region 3*b*, a case where the condition of the following expression (1) is satisfied by adjusting the flow velocity of the airflow 36, is considered.

$$Fg=D \quad (1)$$

$$Fg<D \quad (2)$$

In a case of the relationship of the above-described expression (1), the acceleration of the object P which has fallen to the region 3*b* due to gravity and reaches the region 3*b* becomes 0, but continues to move downward due to the inertial force. At this time, when there is no other acting force, falling after passing through the region 3*b* further continues. Meanwhile, when the downward movement of the object P in the region 3*b* is stopped due to factors, such as a collision with the airflow adjusting body 32, the object P cannot pass through the region 3*b*.

In a case of the expression (2), acceleration is generated upward (direction of airflow) by the force of the difference, and when the object P which has fallen due to gravity decelerates in the region 3*b* and turns to acceleration further upward, the object P cannot pass through the region 3*b*.

In addition, in the suction port 33 and the suction path 34 which are installed immediately above the region 3*b*, in a case where the relationship of the expression (2) is obtained by the same principle described above, and in a case where the movement component exists in the same direction as the airflow even the relationship of the expression (1) is satisfied, the object P can move in the same direction as the airflow, and as a result, it is possible to carry the object P out of the unit sorting unit via the suction path, and to collect the object P.

In addition, when a drag force (D') in the suction port 33 and the suction path 34 is greater than the drag force of the region 3*b*, the ability to more rapidly suction the object P that cannot pass through the region 3*b* is provided. On the other hand, the drag force D immediately under the suction port 33 in the region 3*b* is locally increased, and even the object that passes through the region 3*b* and falls may also be suctioned and collected to deteriorate the sorting accuracy. Here, by adjusting the balance between both of the drag force and the drag force, the sortability can be adjusted according to the purpose.

As described above, in each of the unit sorting units 3, the sorting is controlled by adjusting the airflow introduced into the region 3*b* (main pipe portion 31) and the airflow suctioned from the suction port 33, respectively. Control of the airflow in the former region 3*b* is based on the management and control of a blower on the air supply port side or a flow rate adjusting valve or the like. In addition, the airflow suctioned from the suction port 33 of the latter depends on management and control of the blower or the flow rate adjusting valve or the like on the downstream side of the suction path 34. In other words, in each of the unit sorting units 3, the region 3*b* (main pipe portion 31) and the suction port 33 (and the suction path 34) have independent sortability, respectively, and the sorting operation as a unit becomes possible as both of the region 3*b* and the suction port 33 are adjusted to a condition that can cooperate with each other. In other words, even in the unit sorting unit for a single sorting, a double sorting process which can be controlled and adjusted exists, and accordingly, high sorting accuracy is achieved.

EXAMPLE

Table 1 shows the results of sorting experiments of five types of samples with different materials using the above-described sorting device. All of the samples used in the experiment were substantially granular with an outer diameter of approximately 7 mm, and conditions of unit sorting unit 3 that sorts the object to be sorted were set from the properties of each of the known samples in advance. In the sorting experiment, samples were first mixed, the sample in the obtained mixed state was continuously input into the device from the input port 22, and whether or not each of the samples was collected in each of the predetermined collection tanks is evaluated. Each sample type is sorted with the separation efficiency as high as 90% or more with high accuracy.

TABLE 1

| Type | Number (%) | Collection rate (%) | Overall separation efficiency |
|---|---|---|---|
| Corrugated paper | 0.17 | 0.99 | 0.99 |
| Wooden beads | 0.17 | 0.96 | 0.96 |
| Plastic beads | 0.33 | 0.99 | 0.99 |
| Glass beads | 0.17 | 0.98 | 0.99 |
| Metal (bolt) | 0.17 | 0.98 | 1.00 |

[Example of Effect of Intake Port and Gas Cooling Mechanism]

Figure 25:
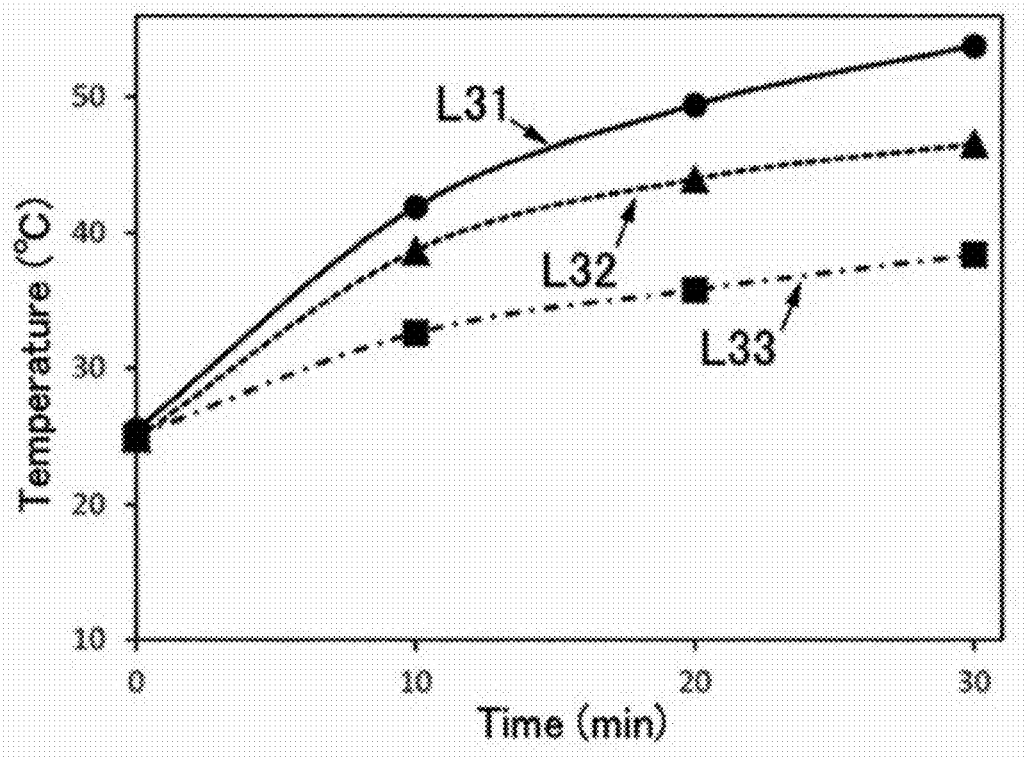
FIG. 25 is a graph showing a change in airflow temperature when circulation, an intake port, and a cooling mechanism are added.

Here, as shown in FIG. 4, in a case where the airflow is recycled (straight line L31 in FIG. 25), as described above, the temperature of the airflow was measured in a case where the intake port 12 for suctioning the external air is provided (dotted line L32 of FIG. 25), and further, in a case where the gas cooling mechanism 14 is provided (one-dot chain line L33 in FIG. 25). The values are shown in FIG. 25. In addition, as operating conditions, the number of unit sorting units 3 was 5, and by using 1200 W class DC blower in air supply, under the environment of approximately 25° C. at room temperature, the intake of the external air from the intake port 12 was reduced to approximately 10% of the entire intake amount, and the cooling capacity of the gas cooling mechanism 14 was approximately 120 W.

As shown in FIG. 25, by adding the intake port 12 or the gas cooling mechanism 14, the airflow temperature during the circulation decreased. The control of the airflow temperature is effective not only in stabilizing the sortability but also from the viewpoint of reduction of the influence or the like of heating on the object depending on the device and additionally, the type. In addition, by adding the intake port 12, the airflow amount of air supply at the uppermost unit sorting unit is relatively increased, and accordingly, the effect of improving the degree of freedom of device design (conduit diameter and the like) can also be obtained.

The above-described airflow sorting device has high accuracy and easy adjustment properties with a simple configuration. Here, for example, in the recycling field, the airflow sorting device is appropriate in a case where debris that has been disassembled, crushed, and separated for each material after being discarded and collected are separated for each material and are sorted from each other, and in a case where small-diameter parts having various compositions, such as elements peeled from the substrate of electronic and electrical equipment, are sorted. In addition, in the resource field, in a case of similarly performing the sorting the natural resources, or in the field of manufacturing and production, the airflow sorting device can be used as a sorting device which is used in distinguishing and sorting the component or removing the impurities.

Above, although the embodiments of the sorting device and the sorting method according to the present invention and the modification example based thereon have been described above, the present invention is not necessarily limited thereto, and those skilled in the art can find various representative embodiments or modification examples without departing from the scope of the present invention or the claims.

REFERENCE SIGNS LIST

1 . . . SORTING SECTION
2 . . . INTRODUCTION UNIT
21 . . . INTRODUCTION PIPE PORTION
22 . . . INPUT PORT
3 . . . UNIT SORTING UNIT
31 . . . MAIN PIPE PORTION
32 . . . AIRFLOW ADJUSTING BODY
33 . . . SUCTION PORT
34 . . . SUCTION PATH
35 . . . CONDUIT
36 . . . FLOW PATH IN SPACE IN CONDUIT IN REGION 3B2
37 . . . FLOW PATH IN SPACE IN CONDUIT IN REGION 3B1
38 . . . INNER DIAMETER ADJUSTING RING
39 . . . AIRFLOW ADJUSTING BODY POSITION ADJUSTING MECHANISM
4 . . . AIR SUPPLY UNIT
41 . . . AIR SUPPLY PIPE PORTION
42 . . . AIR SUPPLY PATH
43 . . . AIR SUPPLY PORT
5 . . . BOTTOM UNIT
6 . . . SOLID-GAS SEPARATION MECHANISM
7 . . . BLOWER
8 . . . FLOW RATE AND FLOW VELOCITY CONTROL SECTION
81 . . . FLOW RATE AND FLOW VELOCITY METER (CONTROL SIGNAL OUTPUT)
82 . . . THERMOMETER (SIGNAL OUTPUT FOR CONTROL)
83 . . . FLOW RATE ADJUSTING VALVE
9 . . . CONTROL DEVICE
10 . . . INTAKE HOOD
11 . . . DUST COLLECTING DEVICE
12 . . . INTAKE PORT
13 . . . EXHAUST PORT
14 . . . GAS COOLING MECHANISM
15 . . . SOLID COLLECTING VALVE
16 . . . COLLECTION TANK

The invention claimed is:

1. A sorting device configured to sort an object to be sorted comprising:

a conduit which has a central shaft line and allows the object to be sorted to fall due to gravity inside the conduit along the central shaft line;

an air supply port provided at a lower part of the conduit and configured to blow air upward along the central shaft line;

a suction port which is provided above the air supply port of the conduit and is an opening oriented downward of a suction pipe provided parallel to the central shaft line; and an input port provided above the suction port of the conduit through which the object to be sorted is input into a periphery of the suction pipe which is in the conduit, wherein the sorting device is configured to sort the object to be sorted according to whether or not the object to be sorted is being suctioned by the suction port together with part or an entirety of an airflow generated in the conduit by the air blown from the air supply port, the sorting device further comprises an airflow adjusting body which is provided below the suction port in the conduit and blocks a falling path of the object to be sorted which falls due to gravity, the airflow adjusting body includes: a vertex on the central shaft line; and an inclined surface having a sectional shape, sectional areas of which are similar to each other and increase in size downward, a drag force which acts on the object to be sorted which falls due to gravity increases downward from the suction port, the conduit has an inner surface inclined portion inclined to expand a horizontal sectional area downward, and the airflow adjusting body is positioned in the inner surface inclined portion, and an inner wall of the conduit located in the inner surface inclined portion includes an inclined portion inclined to expand a horizontal sectional area downward, and to extend along the airflow adjusting body which faces the inclined portion.

2. The sorting device according to claim 1, wherein the airflow adjusting body has a shape of a rotating body.

3. The sorting device according to claim 1, wherein a plurality of suction ports are provided to be open in the same horizontal plane.

4. The sorting device according to claim 1, further comprising:

a second suction port which is an opening oriented downward of a second suction pipe provided above the suction port in parallel to the central shaft line.

5. The sorting device according to claim 4, wherein each of the flow rates of the suction port and the second suction port is independently controllable.

6. The sorting device according to claim 1, wherein the airflow adjusting body has a substantially spindle-like structure.

7. A sorting device configured to sort an object to be sorted comprising:

a conduit which has a central shaft line and allows the object to be sorted to fall due to gravity inside the conduit along the central shaft line;

an air supply port provided at a lower part of the conduit and configured to blow air upward along the central shaft line;

a suction port which is provided above the air supply port of the conduit and is an opening oriented downward of a suction pipe provided parallel to the central shaft line; and an input port provided above the suction port of the conduit through which the object to be sorted is input into a periphery of the suction pipe which is in the conduit, wherein the sorting device is configured to sort the object to be sorted according to whether or not the object to be sorted is being suctioned by the suction port together with part or an entirety of an airflow generated in the conduit by the air blown from the air supply port, the sorting device further comprises an airflow adjusting body which is provided below the suction port in the conduit and blocks a falling path of the object to be sorted which falls due to gravity, the airflow adjusting body includes: a vertex on the central shaft line; and an inclined surface having a sectional shape, sectional areas of which are similar to each other and increase in size downward, a drag force which acts on the object to be sorted which falls due to gravity increases downward from the suction port, the conduit has an inner surface inclined portion inclined to expand a horizontal sectional area downward, and the airflow adjusting body is positioned in the inner surface inclined portion, and the shape of the inner surface inclined portion of the conduit and the inclined surface of the airflow adjusting body is controlled to make the flow velocity of the airflow in the inner surface inclined portion constant in a height direction.

8. The sorting device according to claim 7, wherein the conduit has a ring portion which makes the horizontal sectional area of the inner surface inclined portion oriented downward.

9. The sorting device according to claim 7, wherein the airflow adjusting body positions at least a greatest sectional area portion of the airflow adjusting body in the inner surface inclined portion, and the sectional area of the greatest sectional area portion is greater than the sectional area of an inner surface straight portion.

10. The sorting device according to claim 7, wherein the airflow adjusting body is provided with vertical position adjusting means, is configured to moves up and down in the inner surface inclined portion, and is configured to control the drag force.

11. A sorting method for sorting objects to be sorted, in a sorting device comprising:

a conduit which has a central shaft line and allows an object to be sorted to fall due to gravity inside the conduit along the central shaft line;

an air supply port provided at a lower part of the conduit and configured to blow air upward along the central shaft line;

a suction port which is provided above the air supply port of the conduit and is an opening oriented downward of a suction pipe provided parallel to the central shaft line; and an input port provided above the suction port of the conduit through which the object to be sorted is input into a periphery of the suction pipe which is in the conduit, wherein the sorting device is configured to sort the object to be sorted according to whether or not the object to be sorted is being suctioned by the suction port together with part or an entirety of an airflow generated in the conduit by the air blown from the air supply port, the method comprising:

providing an airflow adjusting body below the suction port in the conduit to block a falling path of the object to be sorted which falls due to gravity such that a drag force which acts on the object to be sorted which falls due to gravity increases downward from the suction port, wherein the conduit has an inner surface inclined portion inclined to expand a horizontal sectional area downward, and the airflow adjusting body is positioned in the inner surface inclined portion, and an inner wall of the conduit located in the inner surface inclined portion includes an inclined portion inclined to expand a horizontal sectional area downward, and to extend along the airflow adjusting body which faces the inclined portion.

12. The sorting method according to claim 11, wherein airflow control is performed such that the flow velocity of the airflow in a side portion of the airflow adjusting body is constant in a height direction.

13. The sorting method according to claim 12, wherein the airflow adjusting body is a rotating body with respect to the central shaft line and has an inclined surface of which a sectional area expands downward.

14. The sorting method according to claim 11, wherein the airflow adjusting body has a substantially spindle-like structure.

* * * * *